US006851795B2

(12) United States Patent
Watanabe et al.

(10) Patent No.: US 6,851,795 B2
(45) Date of Patent: Feb. 8, 2005

(54) CARTRIDGE WITH OPPOSED ELECTRICAL AND INK CONNECTION PORTIONS, AND CARRIAGE AND INK JET RECORDING APPARATUS FOR SAME

(75) Inventors: Itaru Watanabe, Kanagawa (JP); Yutaka Koizumi, Kanagawa (JP); Akihiro Yamanaka, Kanagawa (JP); Hiroyuki Maeda, Kanagawa (JP); Akira Goto, Kanagawa (JP); Hiroki Tajima, Kanagawa (JP); Yasushi Iijima, Tokyo (JP); Toshihiro Sasaki, Kanagawa (JP); Tomoyuki Nagase, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/067,221

(22) Filed: Feb. 7, 2002

(65) Prior Publication Data

US 2002/0118263 A1 Aug. 29, 2002

(30) Foreign Application Priority Data

Feb. 9, 2001 (JP) ..... 2001-033769
Feb. 6, 2002 (JP) ..... 2002-029050

(51) Int. Cl.[7] ..... B41J 2/14; B41J 2/16
(52) U.S. Cl. ..... 347/50
(58) Field of Search ..... 347/50, 20, 84, 347/86, 99, 100, 5, 6; 400/175, 174, 139

(56) References Cited

U.S. PATENT DOCUMENTS 5,448,274 A 9/1995 Hirabayashi et al. ..... 347/86
6,137,513 A 10/2000 Pawlowski, Jr. ..... 347/86
6,402,310 B1 6/2002 Maeda et al. ..... 347/87
6,431,681 B2 8/2002 Hatasa et al. ..... 347/19
6,494,630 B2 * 12/2002 Williams et al.

FOREIGN PATENT DOCUMENTS

EP 808715 11/1997
EP 832748 4/1998

* cited by examiner

*Primary Examiner*—Raquel Yvette Gordon
(74) *Attorney, Agent, or Firm*—Fitzpatrick, Cella, Harper & Scinto

(57) ABSTRACT

A cartridge is detachably mountable to a holder of an ink jet recording apparatus, so as to be freely reciprocatable to scan across a recording medium and record thereon by discharging ink. The cartridge is defined by a cartridge main body, and is provided with a recording head for discharging ink from plural nozzles formed in parallel on a lower face of the cartridge main body facing the recording medium. A front face of the cartridge main body is provided with an electrical connection portion having cartridge electrodes, which are electrically connectable with corresponding electrodes of the holder. A rear face opposite to the front face is provided with an ink connection portion connectable to corresponding supply ports which supply ink to the recording head from a main tank installed elsewhere on the ink jet recording apparatus. With the cartridge thus structured, the force exerted for connection to the supply port does not affect the precision with which the cartridge is mounted on the holder.

28 Claims, 19 Drawing Sheets

CLOCKWISE
(CW)
(CCW)
CCW
θx
−θx
−Y

CARTRIDGE WITH OPPOSED ELECTRICAL AND INK CONNECTION PORTIONS, AND CARRIAGE AND INK JET RECORDING APPARATUS FOR SAME

BACKGROUND OF THE INVENTION

1. Field of the Invention

The present invention relates to the structure of fixing a cartridge to the carriage of an ink jet recording apparatus, and also, relates to the structure of the cartridge.

Here, in order to describe the relationship between the fixing point and the fixing force when the cartridge is mounted on the carriage, it is defined in the specification hereof that the thrust direction of the guide shaft that guides the carriage as the direction X; the carrying direction of a recording medium as the direction Y; and the direction perpendicular to the surface of the recording medium as the direction Z, and that the rotational directions centering on these three axes as θX, θY, and θZ, respectively.

Also, in the specification hereof, the phrase "electrical connection" indicates the state where electrical connection is made, and the phrase "ink connection" indicates the state where the ink receiving portion of a cartridge and a needle are connected in order to supply ink to the cartridge.

2. Related Background Art

The ink jet recording technology is such as to record characters and images directly on a recording medium (such as paper, cloth, plastic sheet) by discharging ink from fine nozzles thereto. Conventionally, the recording apparatus having a recording head of ink jet recording type has been utilized as a printer serving as the output terminal of a copying machine, a facsimile equipment, a printer, a word processor, a work station, or the like or as a handy or potable printer used for such an information processing system as a personal computer, a host computer, an optical disc device, a video apparatus. For the conventional ink jet recording apparatus of the kind, there has been known the one in which an ink jet recording head and an ink tank are formed integrally or the one that uses the ink jet cartridge provided with an ink tank arranged to be detachably mountable on the cartridge. The cartridge of the kind is fixedly supported on the carriage mounted on the ink jet recording apparatus main body to be able to perform scanning reciprocation, while being arranged to be of disposable type, which is detachably mountable on the carriage.

FIG. 16 is a perspective view that schematically shows one example of the vicinity of the carriage of the conventional ink jet recording apparatus. FIGS. 17A and 17B are perspective view that illustrate one structural example of the conventional cartridge of disposable type. FIG. 18 is a perspective view that shows the cartridge represented in FIGS. 17A and 17B, observed from the lower front side thereof.

The carriage 152 of the conventional ink jet recording apparatus is structured to support the cartridge 151 to be detachably mountable. Then, on the inner wall thereof, there are arranged plural electrodes 161. Also, the carriage 152 reciprocates along the guide shafts 154 and 159 for scanning in the direction X which is substantially at right angles to the direction Y in which a recording medium 160 is being carried by use of conveyance means (not shown).

The cartridge 151 comprises plural ink tanks 171, each of which is independently arranged to contain color ink mostly inside thereof each corresponding to color print; a holder 170 that holds the ink tanks 171; and the recording head 172 that discharges ink.

As the recording head 172, there is the one that uses electromechanical converting element, such as piezoelectric element, the one that uses electrothermal converting element, such as heat generating resistive element, or the one that uses magnetic wave mechanical converting element or magnetic wave thermal converting element, such as electric wave or laser, which can be utilized for discharging ink droplets from nozzles. Of the heads of the kinds, the one adopting the method to utilize thermal energy for discharging ink droplets is advantageous in that recording is executable in high resolution, because this method makes it possible to arrange nozzles in high density.

The front face 174 of the holder 170 has a head base plate 173 fixed thereto with plural electric connectors 175 connected electrically with the flexible cable that supplies electric energy to the recording head 172. For the holder 170, plural ribs 176 are formed to be extended in the direction substantially perpendicular to the head base plate 173 fixed to the front face 174.

The cartridge 151 is inserted into the carriage 152 from the opening portion 177, and fixed inside the carriage 152 by rotating the head set lever 153 in the direction indicated by an arrow a. Then, the abutting point 166 of the cartridge 151 abuts against the θZ rotation stop point 163 each arranged at two locations, the left and right sides of the inner wall of the carriage 152, and the head base plate 173 is received with the reaction force of the electrodes 161 being depressed to the electrodes 161 centering on them. The cartridge 151 is drawn into the electrode 161 side by the toggle mechanism by rotating the head set lever 153 further in the direction indicated by the arrow a, and abuts against the θX rotation stop point 162 to fix the carriage 152. The conventionally exemplified cartridge 151 is fixed to the carriage 152 at these three points, the θZ rotation stop points 163 on the left and right sides, and the θX rotation stop point 162.

The holder 170 of the cartridge 151 thus fixed to the carriage 152 receives reaction force from the electrodes 161, but the ribs 176 prevent the holder 170 from being deformed by such reaction force. Then, with the support by the ribs 176 over the front face 174, the head base plate 173 is not deformed to make it possible to connect electrically the electric connectors 175 and the electrodes 161 of the carriage 152 stably.

In recent years, however, the multiple use of ink for a color printer has advanced in order to record in higher quality, and the numbers of recording element to be used is increased, while the length of nozzles is made larger to implement higher recording. As a result, the recording area of the recording head is expanded. Along with this, the area of the head base plate is expanded with the increased numbers of electric connectors corresponding to the increased numbers of nozzles. However, it becomes more difficult for a plate member like the head base plate to keep robustness, as the area thereof is made wider. Also, in order to receive the supply of electric power through the pressurized contact with the electrodes of the carriage, it may be impossible to receive the electric supply stably unless suppressed with reaction force of as much as approximately 69 kN at the maximum if each pin is suppressed with reaction force of 490 N.

Fundamentally, ribs are provided for the inside of the holder in order to suppress the deformation of the head base plate and the head partition wall that serves as the front face of the holder, which may be caused by the pressure thus added. However, the ribs are extended from the bottom face of the inner wall of the holder toward the head partition wall, and the power that supports the head base plate is small. There is no problem if a head base plate is small even if ribs are extended from the bottom face of the holder only to a portion nearby. If the area of head base plate becomes larger than the conventional one, the area of the head partition wall that should be supported becomes larger accordingly as a matter of course, and it becomes extremely difficult to support the head base plate including the wide area of the partition wall only by the ribs extending from the bottom face of the head without creating any deformation.

Also, as described above, if the cartridge having the head base plate that needs a large fixing force, as it becomes larger, should be fixed to a carriage, the power added to the head set lever should be larger or the head set laver should be made larger in order to implement the exertion of pressure over the reaction force received by the carriage from the electrodes of the carriage. Nevertheless, if the force that should be added to the head set lever is made larger, its operability becomes unfavorable due to the increased force needed for operation or there is a fear that such force exceeds the limit of stress of the head set lever that has been formed by molding. On the other hand, if the arm of the head set lever is made longer while setting the force to be added to the head set lever at an appropriate value, the size of the cartridge should be made larger to ensue in making the apparatus larger accordingly. Also, if the force that should be added to the head set lever becomes larger, there is a fear that the deformation of the cartridge and head base plate is made greater.

Also, the main body portion of the cartridge is often molded for formation, and along with the trend that it becomes larger, molding deformation is no longer negligible.

Further, in recent years, the number of nozzles of the discharge unit is made larger in order to shorten the recording time, and the length of nozzle is made larger, the amount of ink per discharge becomes as fine as several pl, which requires the precise installation of cartridge of several tens micron order with respect to a recording medium.

The preciseness of the kind is determined by the precision of the mechanism for carrying a recording medium, the precision of the guide shaft for the carriage that reciprocates across the recording medium, the precision of the positioning point of the carriage with respect to the cartridge, and the precision with which the cartridge is made.

Particularly, the deviation of impact of ink on a recording medium in the direction with the vertical axis as the center of rotation generates the displacement of ruled lines or deviation of color formation. The precision in different directions may also contribute to the aforesaid impact deviation as a matter of course, but the greatest cause for this impact deviation is the precision with which nozzles are installed in the rotational direction centering on a recording medium and the vertical axis.

For the conventional head, the θX rotation stop is arranged only at one point in the center above the electric connectors. This location is the center of beam, observed from the cartridge main body, and the portion where deformation becomes greatest. Positioning at the location where the deformation is greatest itself is unfavorable, and worst if some unexpected event may take place or it should be taken into consideration that deformation may possibly exceed the limit of elasticity.

Even at present, there is a need for providing the parallelism of approximately 20 micron if the receiving portion of the carriage is taken into the measurement criterion with respect to the guide shaft for a printer of high image quality. However, this precision is a limit even now, and it takes a long time to achieve the degree of this precision, and also, it tends to be unstable to make the control complicated. Therefore, it is extremely difficult to attain any higher precision in this respect.

Also, for the high image quality printer, not only high speed recording is required, but also, the design consideration begins to be needed for the use thereof at a site where a large scale recording is executed. Consequently, such a disposable type as exemplified for the conventional art presents disadvantage in terms of the weight when an ink tank of a large capacity should be mounted on a movable unit. To cope with the situation, it becomes necessary to adopt the mode in which an ink tank of a large capacity is not mounted on a carriage, but use a tube to connect them, through which ink is supplied from the ink tank to a recording head. FIG. 19 is a perspective view that schematically shows one example of the ink jet recording apparatus structured to have such an ink tank of large capacity fixed on the recording apparatus main body side. As shown in FIG. 19, the structure is arranged so that ink is supplied from the main tank 104 fixed to the recording apparatus main body side to the cartridge 101 mounted on the carriage 102 through the tube 106.

For a recording apparatus of the kind, there is disclosed the recording apparatus in the specification of Japanese Patent Application Laid-Open No. 10-128992, which is structured to connect the tube at the same time when cartridges are replaced. The recording apparatus thus disclosed in the specification thereof makes it possible to complete the connection of the tube simultaneously with the insertion of the cartridge into the carriage. However, since the electrical connection and the tube connection are executed at the same time, the direction in which pressure is exerted to position the cartridge and the direction in which the inserting force is exerted together with the electrical connection are caused to vary. Also, in accordance with the example disclosed in the aforesaid specification, the cartridge is structured to be one line/one color, and there is no problem as to the robustness of the cartridge. For example, however, if six-line nozzles are mounted on one piece of cartridge, the electrical connection and ink connection portions are increased, and the load is increased accordingly, while the span of the robust wall face of the member that forms the cartridge is elongated to make it conceivably difficult to keep the required robustness. In other words, the precision with the cartridge should be installed is inevitably reduced, and it is conceivable that a problem is encountered that the impact precision is degraded eventually.

SUMMARY OF THE INVENTION

Here, therefore, it is an object of the present invention to provide a cartridge with enhanced robustness, a carriage capable of fixing the cartridge reliably with a small force of operation, and a cartridge and a carriage having high positioning precision, as well as to provide a recording apparatus and a recording head.

In order to achieve the object describes above, a cartridge of the invention is detachably mountable on holding means of an ink jet recording apparatus, which is freely reciprocatable to scan for recording by discharging ink to a recording medium, and provided with a recording head for discharging ink from plural nozzles formed in parallel on the lower face of the cartridge main body facing the recording medium. For this cartridge, the front face of the cartridge main body, an electrical connection portion having an electrode on the cartridge side is provided and electrically connected with an electrode of the holding means on holding means side, and for the rear face opposite to the front face, an ink connection portion having supply means connected thereto is provided to supply ink to he recording head from the main tank installed on the main body of the ink jet recording apparatus.

The cartridge of the invention thus structured has the front face on which reaction force is exerted at the time of electrodes on the cartridge side being electrically connected with the electrodes of this holding means on holding means side with mechanical pressure exerted thereon, and the rear face on which reaction force given by supply means is exerted when the supply means for supplying ink is physically connected with the ink connection portion. Therefore, with the cartridge being positioned to holding means against the force exerted by the electrical connection, the force exerted for connecting the supply means is in the same direction as the force exerted for positioning. Then, the force exerted for connecting the supply means does not weaken the force exerted on the holding means for positioning. As a result, there is no possibility that the force exerted for connecting the supply means produces any unfavorable effect on the precision with which the cartridge is positioned with respect to the holding means.

DESCRIPTION OF THE PREFERRED EMBODIMENTS

Next, with reference to the accompanying drawings, the embodiments will be described in accordance with the present invention.

Figure 1:
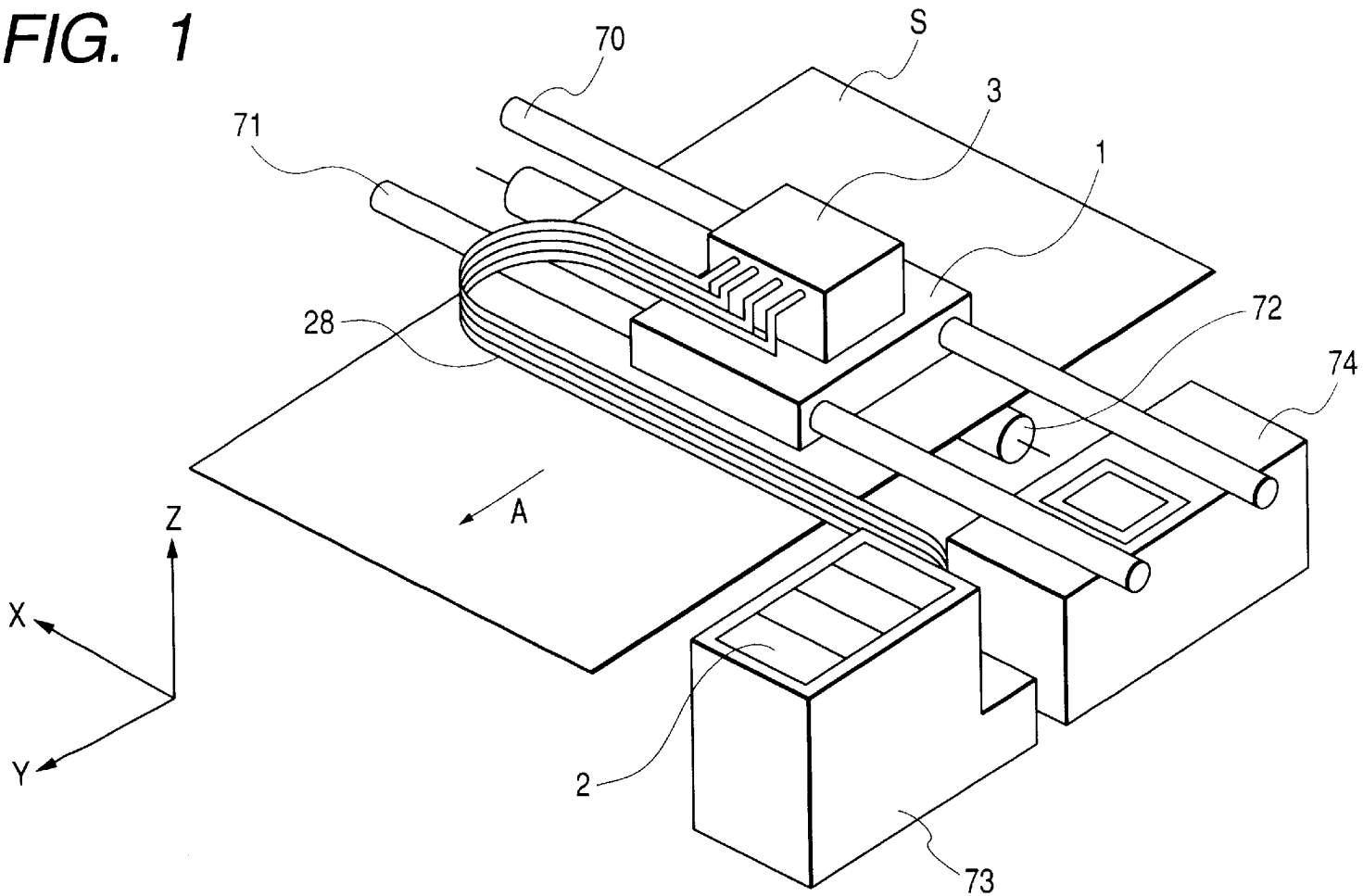
FIG. 1 is a perspective view that shows schematically an ink jet recording apparatus in accordance with one embodiment of the present invention.

With reference to FIG. 1, the description will be made of one example of an ink jet recording apparatus embodying the present invention.

The ink jet recording apparatus shown in FIG. 1 is the serial type recording apparatus in which the reciprocation (main scanning) of the ink jet recording head 69 (see FIG. 2) and the conveyance (sub-scanning) of a general recording paper sheet, a special paper sheet, an OHP film, or other recording sheet S per designated pitch are repeated, and in synchronism with such movement, ink is selectively discharged from the ink jet recording head 69 to enable it to adhere to the recording sheet S for the formation of characters, symbols, images, or the like.

In FIG. 1, the cartridge 3 provided with the ink jet recording head 69 is detachably mounted on the carriage 1 slidably supported by two guide shafts 70 and 71, which reciprocates along the guide shafts 70 and 71 by driving means such as a motor (not shown). The recording sheet S is carried in the direction intersecting with the traveling direction of the carriage 1 (the orthogonal direction indicated by an arrow A, for example) by means of the carrying roller 72 in such a manner that it faces the ink discharge surface of the ink jet recording head 69, and maintains a constant distance to the ink discharge surface.

The ink jet recording head 69 is provided with plural nozzle arrays in order to discharge ink of different colors, respectively. Plural independent ink tanks 2 are detachably mounted on the ink supply unit 73 corresponding to ink of each color discharged from the ink jet recording head 69. For the ink supply unit 73 and the ink jet recording head 69, plural tubes 28 are connected with the cartridge 3 corresponding to ink of each color, and when the main tank 2 is installed on the ink supply unit 73, it becomes possible to supply ink of each color retained in the main tank 2 independently to each nozzle array of the ink jet recording head 69.

Within the range of the reciprocation of the ink jet recording head 69, but the non-recording area that is the area outside the passing range of the recording sheet S, a recovery unit 74 is arranged to face the ink discharge surface of the ink jet recording head 69. The recovery unit 74 is provided with a capping portion for capping the ink discharge surface of the ink jet recording head 69; a suction mechanism for sucking ink compulsorily from the ink jet recording head 69 in a state of the ink discharge surface being capped; and a cleaning blade for wiping off stains from the ink discharge surface, among some others.

Here, in FIG. 1, the example of the serial type ink jet recording apparatus is illustrated for description, but the present invention is applicable to the ink jet recording apparatus that has a line type ink jet recording head mounted thereon, in which the nozzle array is arranged over the entire widthwise direction of a recording medium.

Figure 2:
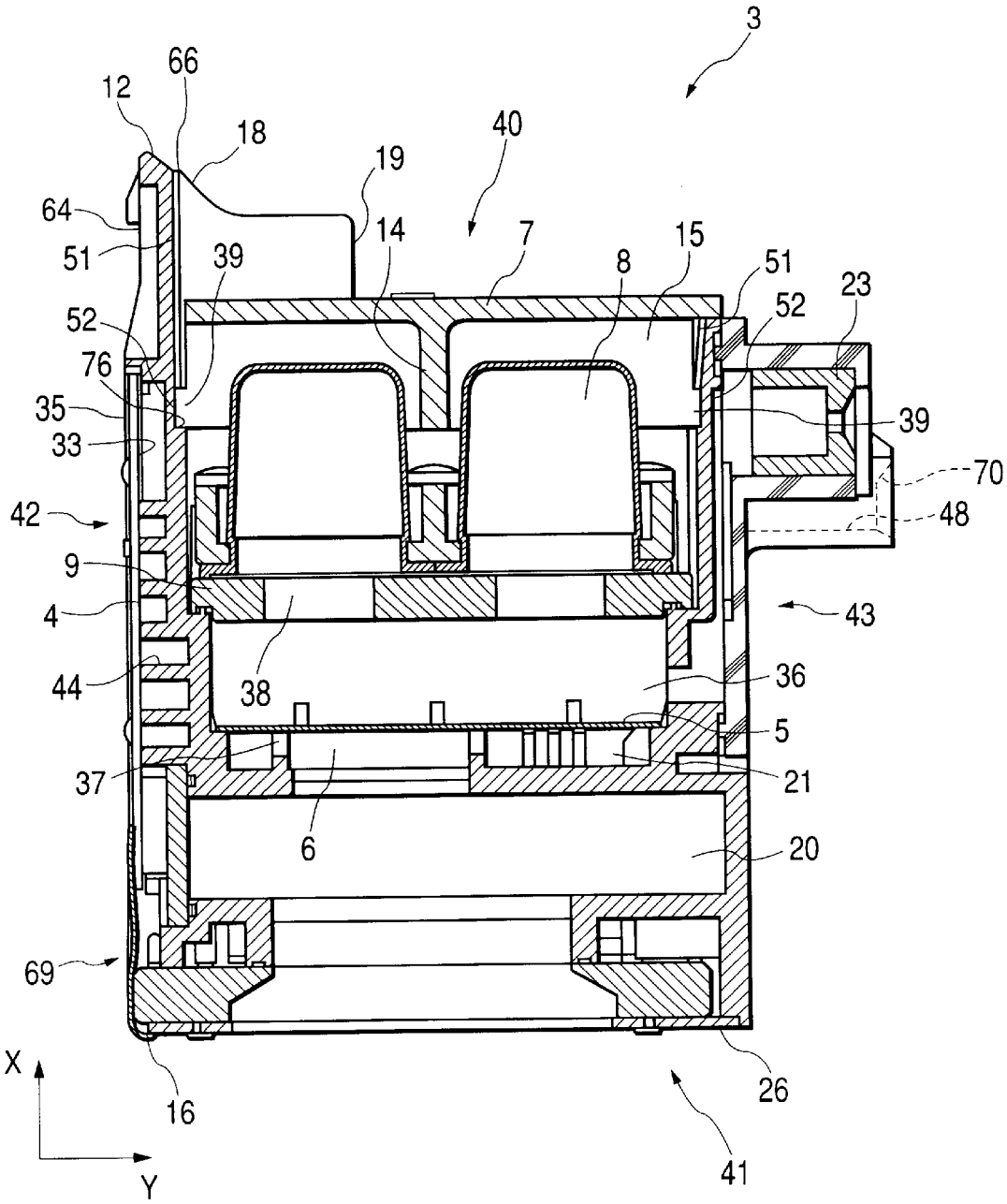
FIG. 2 is a side sectional view that shows a cartridge in accordance with one embodiment of the present invention.
Figure 3:
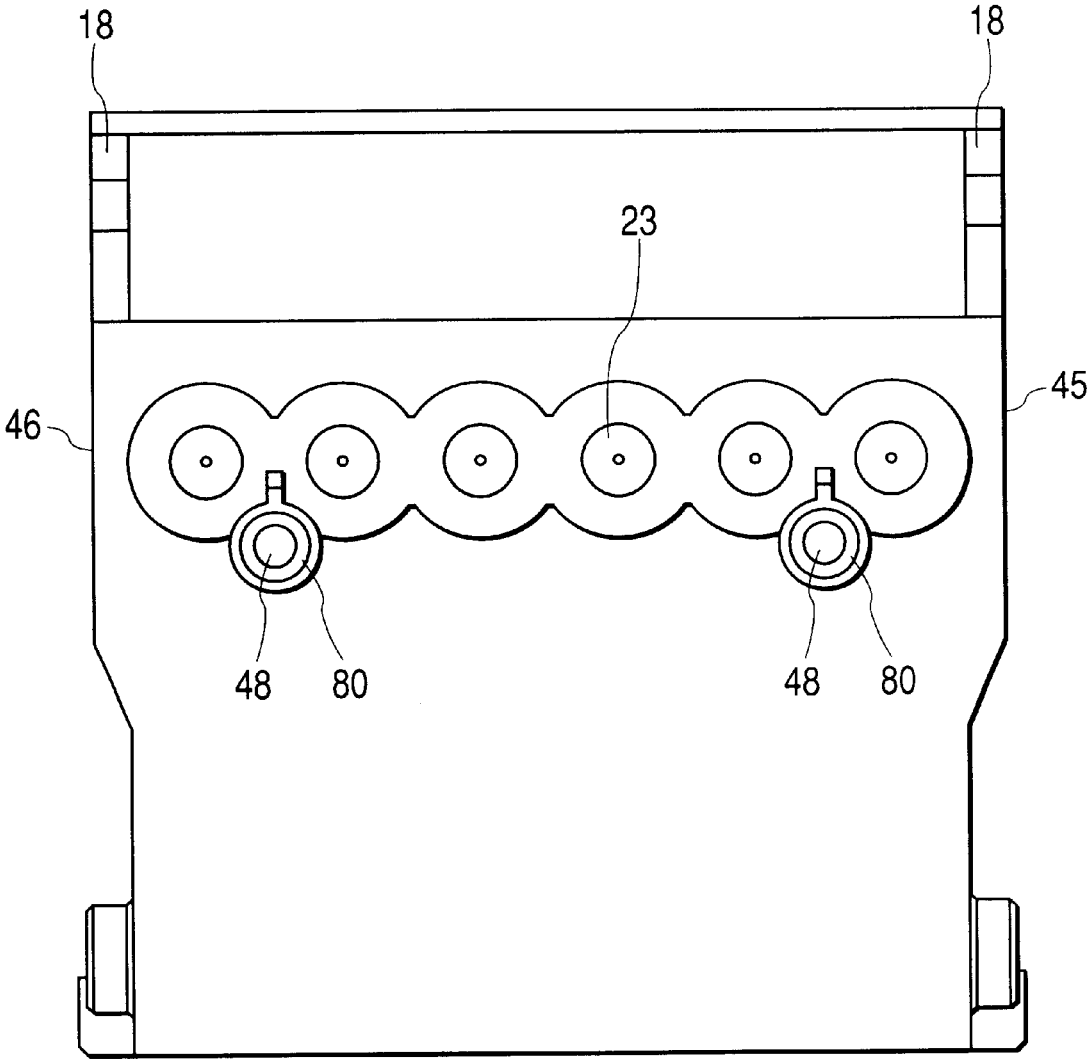
FIG. 3 is a front view that shows the cartridge in accordance with one embodiment of the present invention, observed from the needle receptive side.
Figure 4:
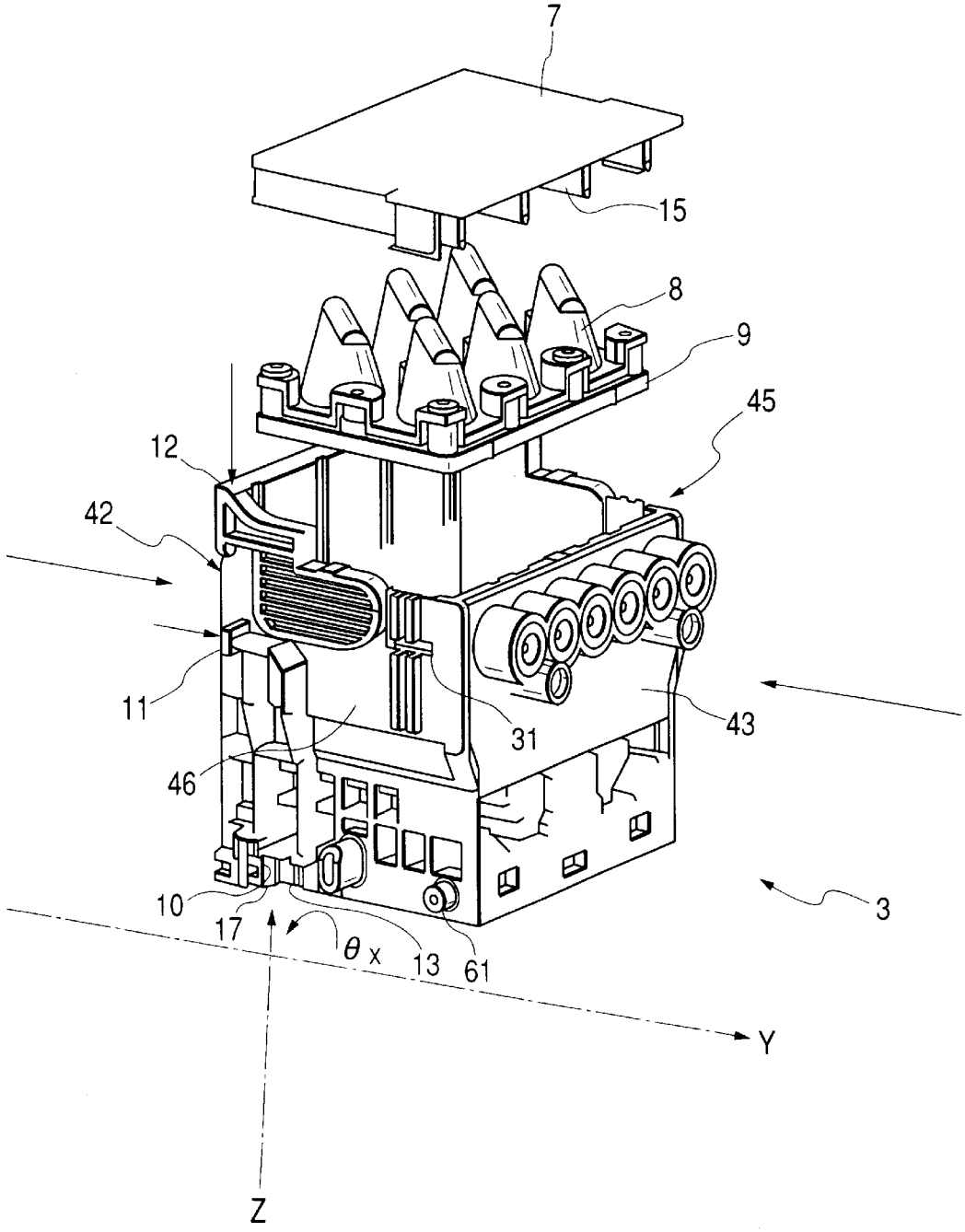
FIG. 4 is an exploded perspective view that shows the cartridge in accordance with one embodiment of the present invention.
Figure 5:
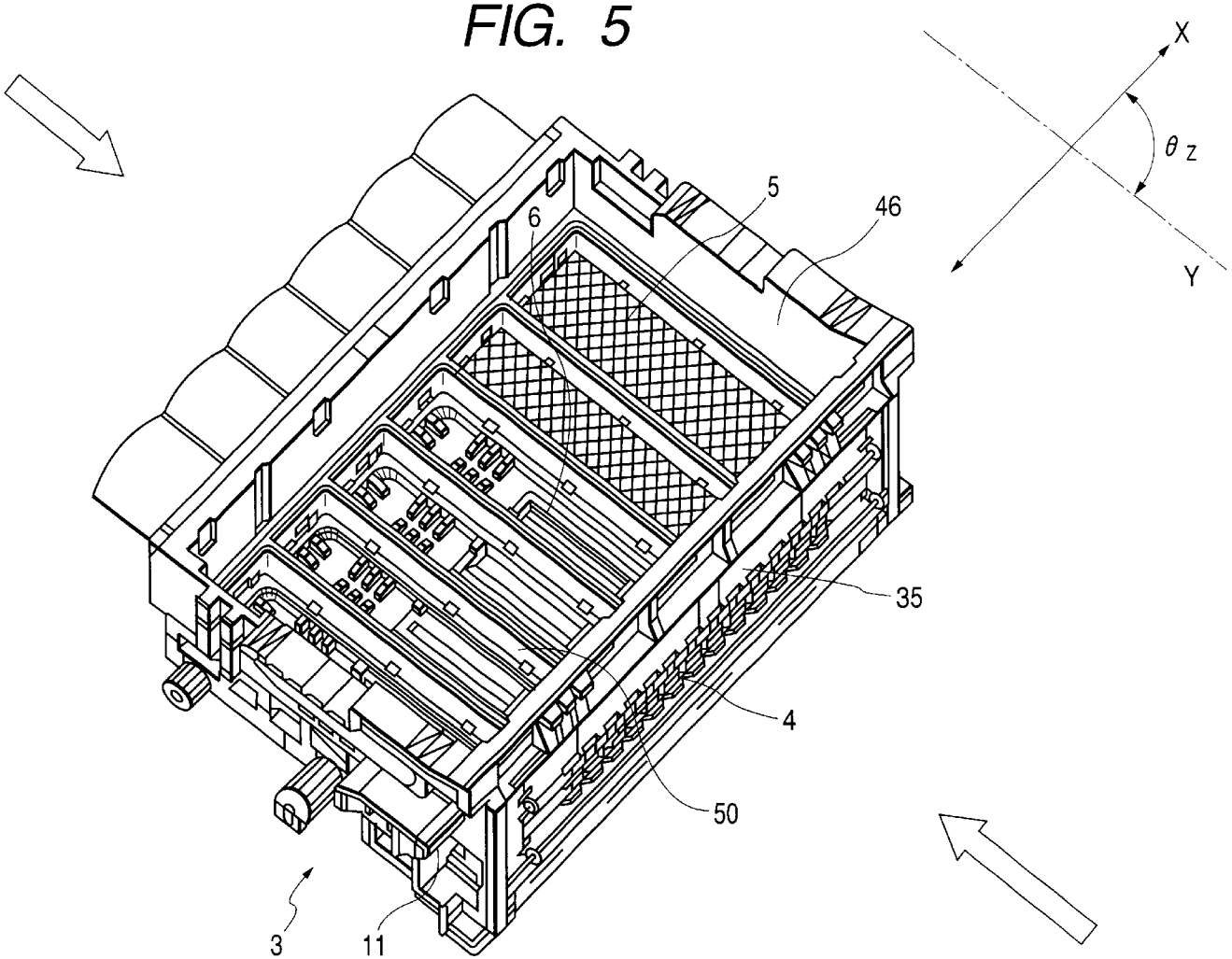
FIG. 5 is a perspective view that shows the cartridge in accordance with one embodiment of the present invention, observed from above in a state of the face cover being removed.

Next, FIG. 2 is a side sectional view that shows a cartridge in accordance with the present embodiment of the present invention. FIG. 3 is a front view that shows the cartridge in accordance with the present embodiment, observed from the needle receptive side. FIG. 4 is an exploded perspective view that shows the cartridge in accordance with the present embodiment. FIG. 5 is a perspective view that shows the cartridge in accordance with the present embodiment, observed from above in a state of the face cover being removed.

The configuration of the cartridge 3 of the present embodiment is formed almost by six faces, the upper face 40, lower face 41, front face 42, rear face 43, and the right side 45, and the left side 46, and with the exception of the upper face 40 side, these are formed integrally. Also, the cartridge 3 of the present embodiment is capable of discharging ink of six colors, and the structure is arranged in such a manner that ink of each color is supplied from the main tank 2 to each of six portions (hereinafter, also referred to as sub-tank) 36, which is formed with partitions arranged by use of the partition wall 50, through the needle 30 (see FIG. 8) of the needle holding member 24 connected with the needle receptive portion 23 per color. Ink supplied to this sub-tank 36 is once retained in the ink retainer 21 through the filter 5 that filters impurities, and then, flows into the liquid chamber 20 through the communicative portion 37 and flow path 6. The ink that has flown into the liquid chamber 20 is discharged from plural discharge ports 29 (see FIG. 7) arranged in parallel in the direction X per color by means of bubble energy generated by the electrothermal element (not shown) that converts electric energy supplied from the heater board 26 arranged on the lower face 41 to thermal energy.

Figure 6A:
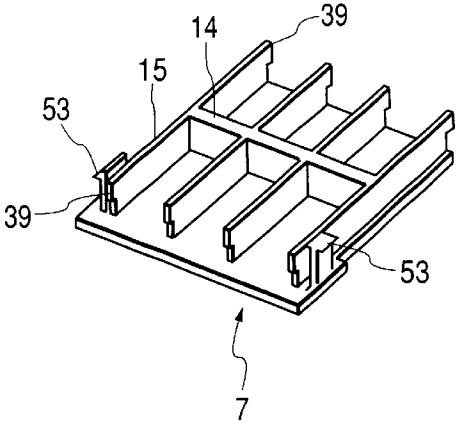
FIGS. 6A, 6B, 6C, 6D and 6E are perspective views that illustrate the face cover in accordance with one embodiment of the present invention, observed from the side where ribs are formed.

For the upper part of the sub-tank 36, there is provided a pressure adjustment chamber 8 communicated with the inside of the sub-tank 36 through the air hole 38 formed for the sub-tank cover 9, which is formed by elastic material, such as rubber, to absorb the abrupt changes of pressure in the sub-tank 36. To protect this pressure adjustment chamber 8, there are provided for the upper face 40 of the cartridge 3, which is the upper part of the pressure adjustment chamber 8 as shown in FIG. 6A, ribs 15 integrally formed in the direction Y from the front face 42 toward the rear face 43 of the cartridge 3; and the face cover 7 that has reinforcement ribs 14 integrally formed in the direction X intersecting with the ribs 15. The coupling portion 39 of the face cover 7, which is formed to extrude to the end portion of the ribs 15, is guided by the taper portion 51 formed for the inner wall of the cartridge 3 to open to the upper face 40 side to slid into the vertical portion 52, which is substantially in parallel to the head base plate 35 to be described later, which is positioned between the taper portion 51 and the abutting portion 76 upon which abuts the end portion of the ribs 15, and then, both end faces of the coupling portion 39 are fitted into the cartridge 3 at this vertical portion 52, while being pressed to be in contact with the inner walls thereof. Further, the nail portion 53 is fixed to engage with the coupling hole 31 of the cartridge 3.

Also, the heights of the taper portion 51 and the vertical portion 52 in the vertical direction is made higher than that of the ribs 15, while the ribs 15 and the reinforcement ribs 14 are arranged not to interfere with any parts of the cartridge 3 with the exception of the taper portion 51 or the vertical portion 52. In this way, the face cover 7 can be fixed by abutting it against the opening end face 76. At this juncture, the ribs 15 function and correct the warping, deformation, or the like of the cartridge main body that may have been caused at the time of molding.

The ribs 15, and the partition walls 50 that partition not only the sub-tank 36, but also, the ink retainer 21, flow path 6, and liquid chamber 20 per color are given function to make robustness of the cartridge 3 higher in the direction Y. Also, the robustness of the cartridge 3 in the direction X, that is, the side direction, is secured by the presence of the reinforcement ribs 14 of the face cover 7 and the sub-tank cover 9.

Figure 6B:
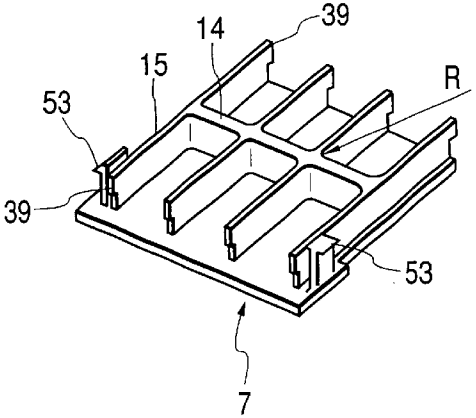
Figure 6C:
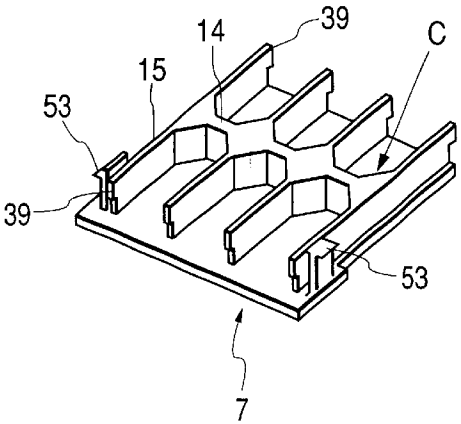
Figure 6D:
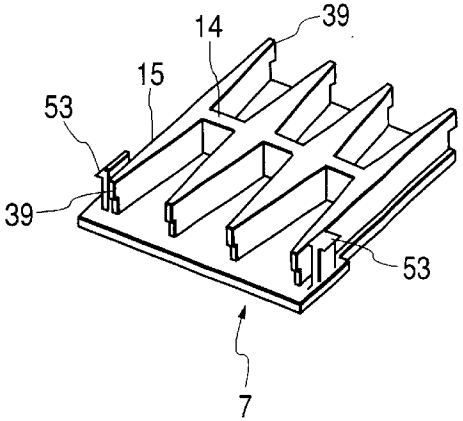
Figure 6E:
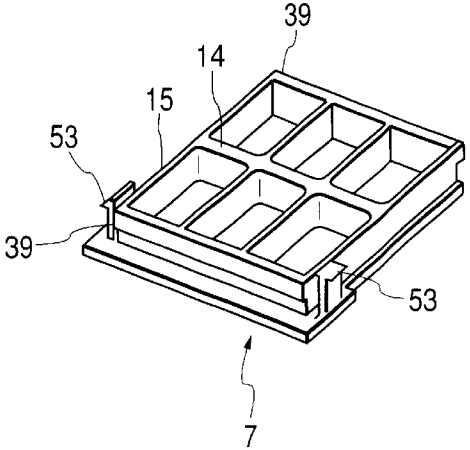

As shown in FIG. 6B, the face cover may be formed to provide curved surface at the intersecting point of the rib 15 and the reinforcement rib 14 in order to make robustness higher in the direction Y. Also, as shown in FIG. 6C, the structure may be arranged to reinforce the intersecting point with the C-letter chamfering so as to make robustness in the direction Y higher. Further, as shown in FIG. 6D, the structure may be arranged to configure the rib 15 so that it becomes thicker as it is located nearer to the central portion, and to make robustness higher in the direction Y. Also, as shown in FIG. 6E, the rib-type face is arranged on the end face of the rib 15, with which it is in contact with the inner wall of the cartridge 3 under pressure. Also, these configurations can be combined as a matter of course.

Also, the partition wall 50 is integrally formed with the cartridge 3 main body to link the front face 42 and the rear face 43. Further, the partition wall 50 is structured to be almost orthogonal to the scanning direction of the carriage 1 in the longitudinal direction thereof. As a result, it becomes possible to minimize the swinging of ink in the sub-tank 36 or the liquid chamber 20 due to vibrations of the carriage 1 at the time of scanning.

The head base plate 35 is fixed to the front face 42 of the cartridge 3, which is the opposite side of the rear face 43 where the needle receptive portion 23 is arranged, and which also becomes the depth end side when the recording apparatus main body is installed. For this head base plate 35, the electrodes 4 on the plural cartridge side are provided, which are electrically connected by means of depression to the plural electrodes 27 provided for the inner wall of the carriage 1. Also, this head base plate 35 is supported by the end faces of plural front ribs 44 formed on the front face 42 of the cartridge 3 from the rear face 33 on the rear side of the base plate, that is, the rear face of the area having the arrangement of the electrodes 4 on the cartridge side. In other words, the head base plate 35 is fixed to the front face 42 of the cartridge 3 with the robustness in the direction Y on the upper face 40 side being secured by the ribs 15 of the face cover 7 serving as a member material, and also, with the robustness in the direction Y being secured by the partition wall 50 connected with the front face 42 in the position intersecting with the projected face in the direction of the reaction P1 (see FIG. 13) received from the electrode 27 on the arrangement area of the electrodes 4 on the cartridge side provided for the head base plate 35. Further, the head base plate 35 is supported by the front face ribs 44 from the rear face 33 side of the base plate as described above. For the head base plate 35, therefore, the flatness is secured against the pressure in the direction Y from the front face 42 toward the rear face 43, which is exerted by the electrodes 27 to be pressed when mounted on the carriage 1 so that each electrode 27 is connected with each of the electrodes 4 on the cartridge side by means of substantially equal pressure. Here, for the present embodiment, in order to prevent the head front face from being deformed by the contact with the electrodes on the cartridge side, the corresponding portion is made thicker. Also, there is a possibility in general that the so-called "sink mark" is created at the time of molding if thickness is made larger. Therefore, as shown in FIGS. 6A to 6E, the corresponding portions are configured to be "lightening sections".

Figure 7:
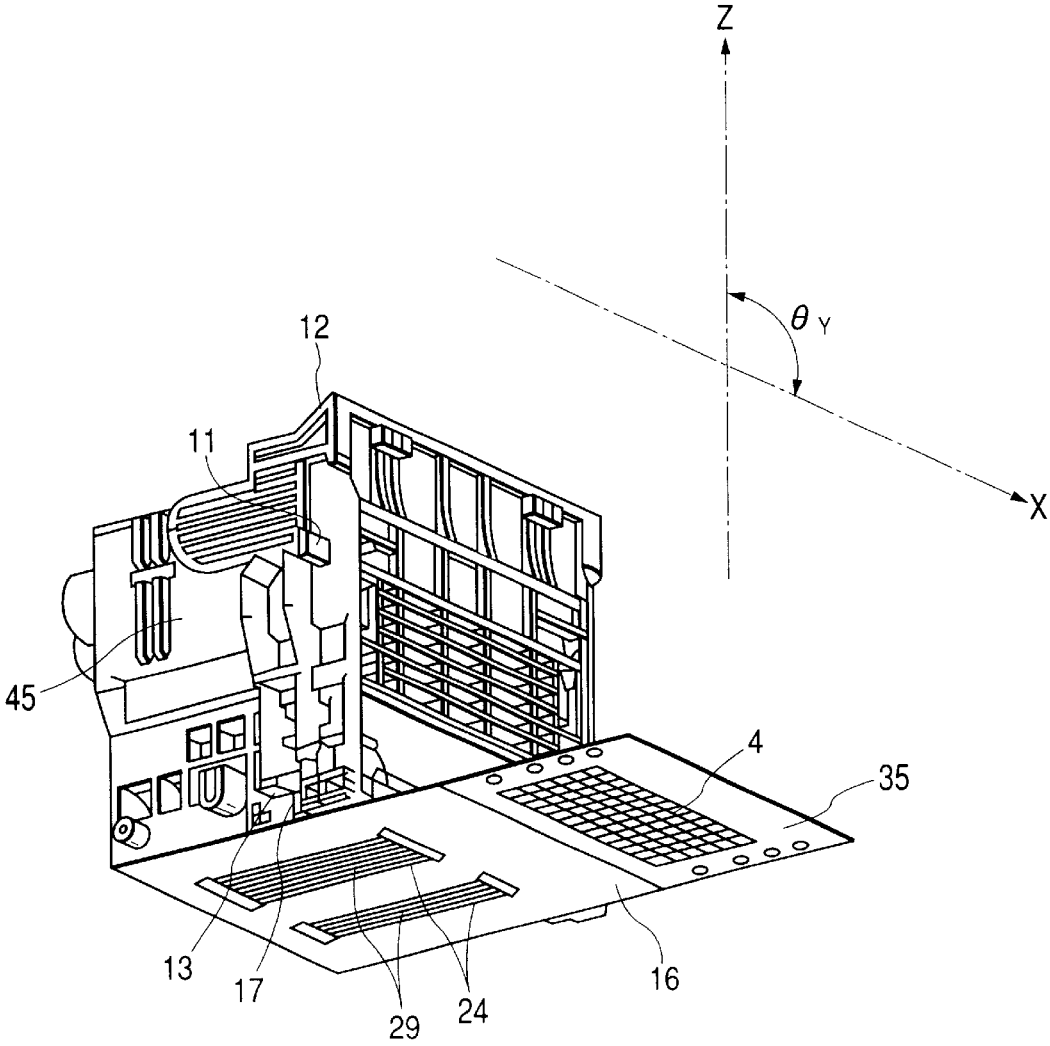
FIG. 7 is a perspective view that shows the cartridge in accordance with one embodiment of the present invention in a state before the head base plate is fixed to the front face of the cartridge.

Further, it is required to make the contacting portions to be flat in order to keep its contact in good condition. For that matter, the corresponding portions are latticed to enhance the flatness thereof (see FIG. 2). Also, as shown in FIG. 7, the head base plate 35 is electrically connected with the heater board 26 by use of a flexible board 16. Here, FIG. 7 shows the state before the head base plate 35 is fixed to the front face 42 of the cartridge 3.

For the right side face 45 and left side face 46 of the cartridge 3, there are provided a first Y directionnal-positioning portion 11, a second Y directional-positioning portion 17, and a Z directional-positioning portion 13, respectively, for positioning the cartridge 3 to the carriage 1 when the carriage 1 is mounted on the carriage. In other words, all the positioning portions are provided for the two side faces, that is, the right side face 45 and left side face 46, which are aside from the front face 42 where electrical connection is made, the rear face 43 serving as the ink connection face where the needle receptive portion 23 and needle 30 are connected, the lower face 41 where the discharge ports 29 are formed, and the upper face 40, hence arranging the structure to eliminate the exertion of force in the direction (perpendicular to the side wall) in which the structural wall on the side face is caused to be warped so as to enable the force that may collapse the structural wall to face them, hence minimizing the deformation of each positioning portion.

Also, on the upper end side of the right side face 45 and left side face 46, a first pressure portion 12 and second pressure portion 19 are formed, which are portions to receive pressure for fixing the cartridge 3 to the carriage 1. The first pressure portion 12 is inclined to the front face 42 in a state of the cartridge 3 being mounted on the carriage 1, while the second pressure portion 19 is almost in parallel to the front face 42. Between the first pressure portion 12 and the second pressure portion 19, an inclined portion 18 is formed to allow the head set unit 54 (see FIG. 13) to slide thereon. Also, between the first pressure portion 12 and the inclined portion 18, a hook 66 is formed to hook the head set unit 54 so as to hold the pressure exerted by the head set unit 54 on the first pressure portion 12.

In this respect, the positioning by means of the first Y directional-positioning portion 11, second Y directional-positioning portion 17, and Z directional-positioning portion 13, and the fixation by means of the first pressure portion 12 and second pressure portion 19 will be described later.

Figure 8:
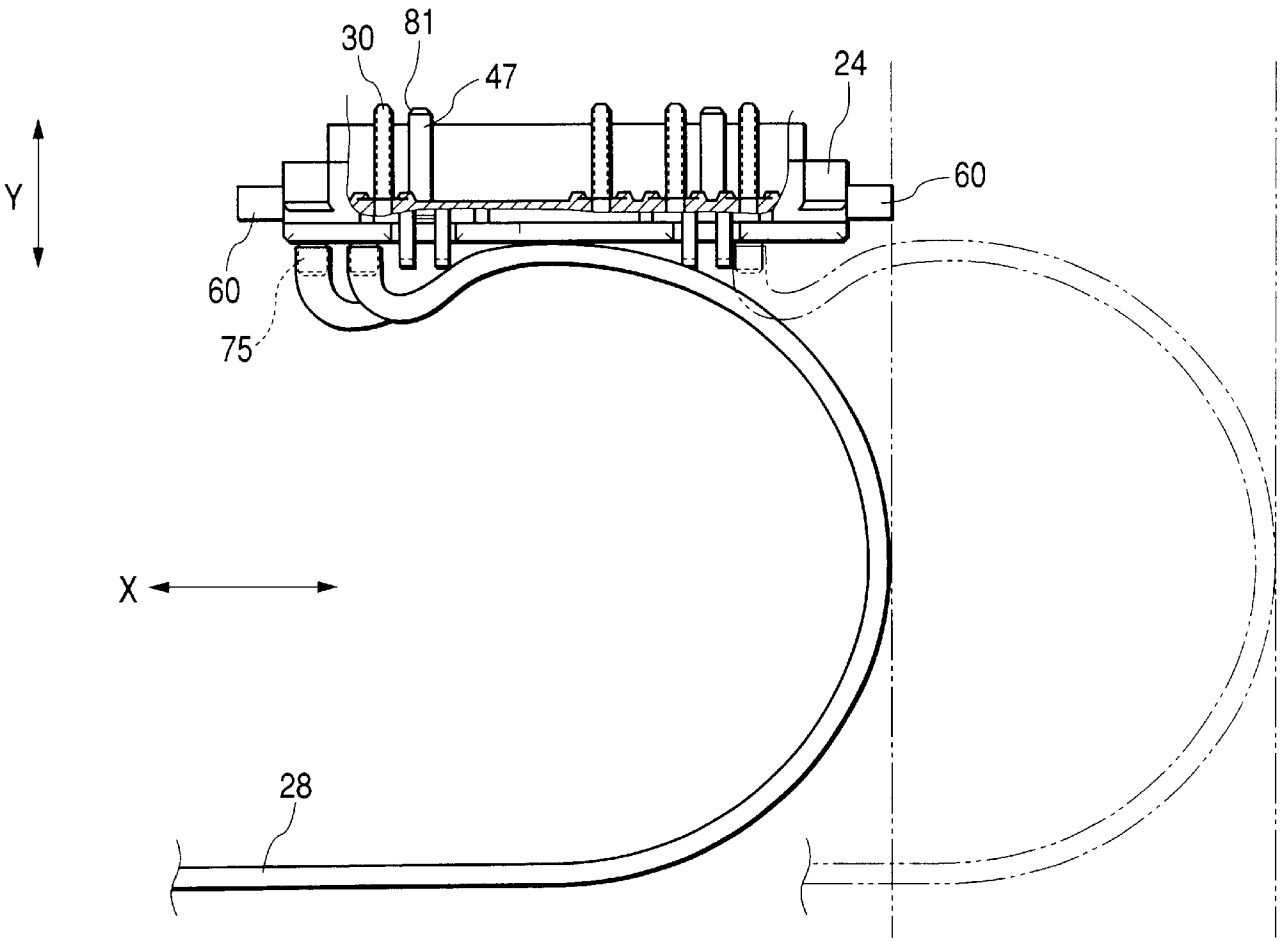
FIG. 8 is a partially broken plan view that shows needle retaining portion.
Figure 11:
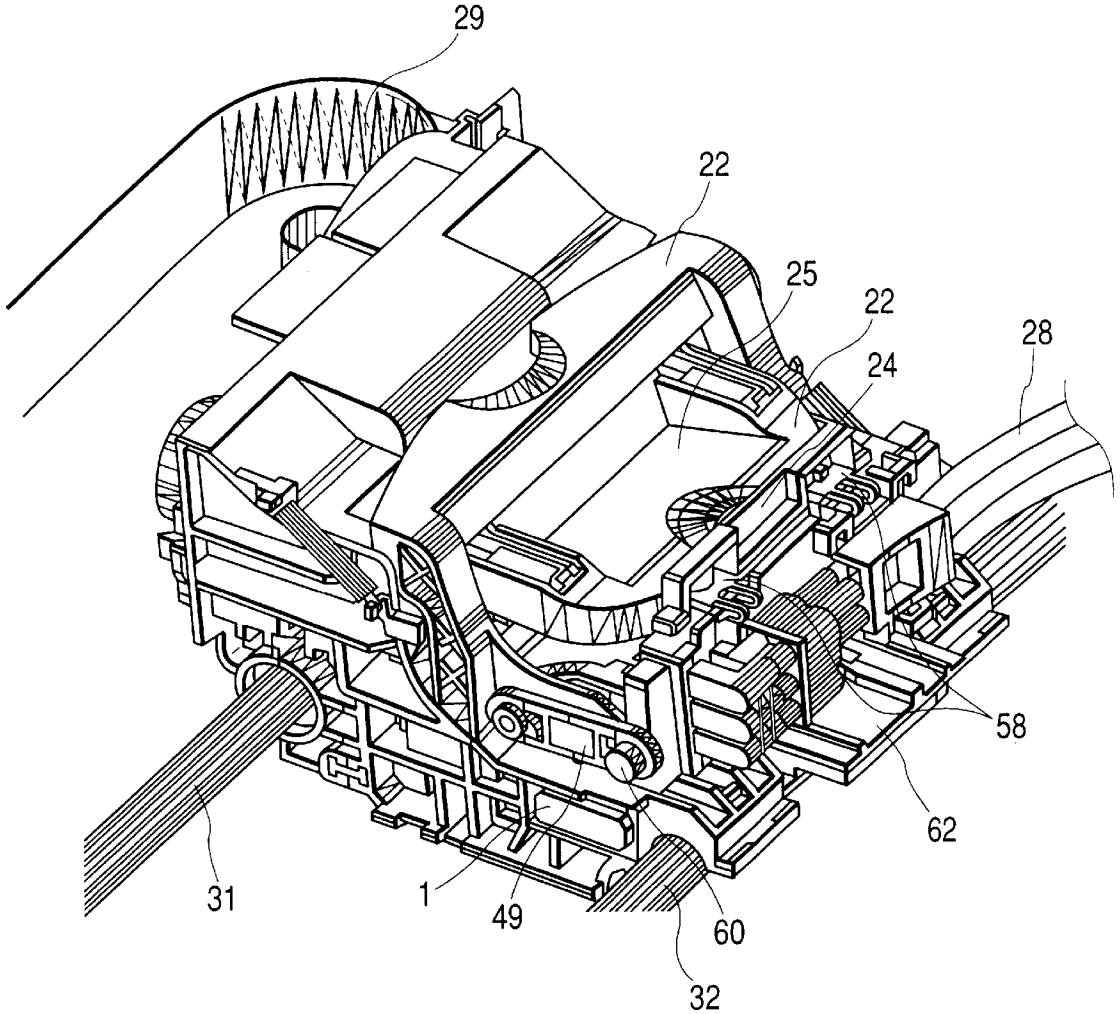
FIG. 11 is a perspective view that shows the state where both the head set lever and the ink connection lever are closed.
Figures 15A, 15B, 15C:
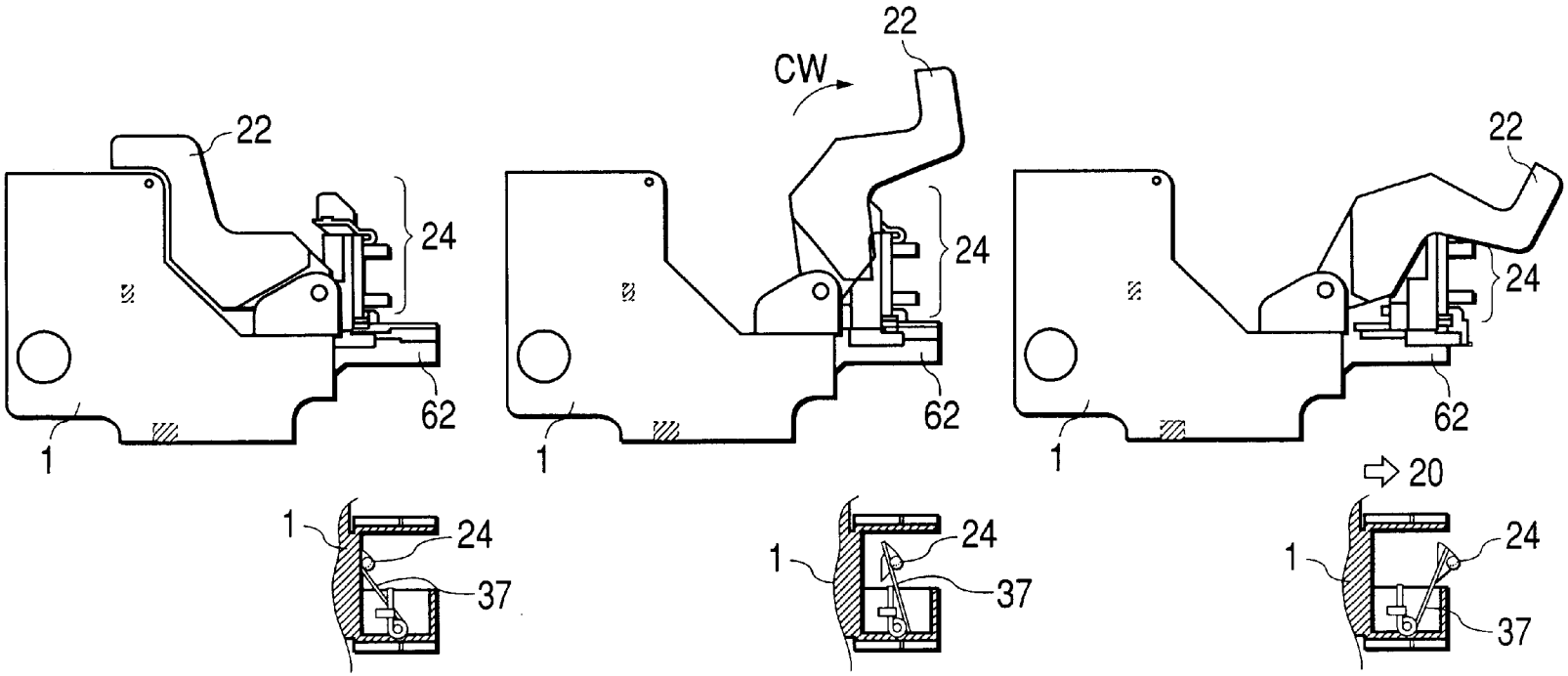
FIGS. 15A, 15B, and 15C are views that illustrate each step of the procedure in which the cartridge is removed from the carriage.
Figure 16:
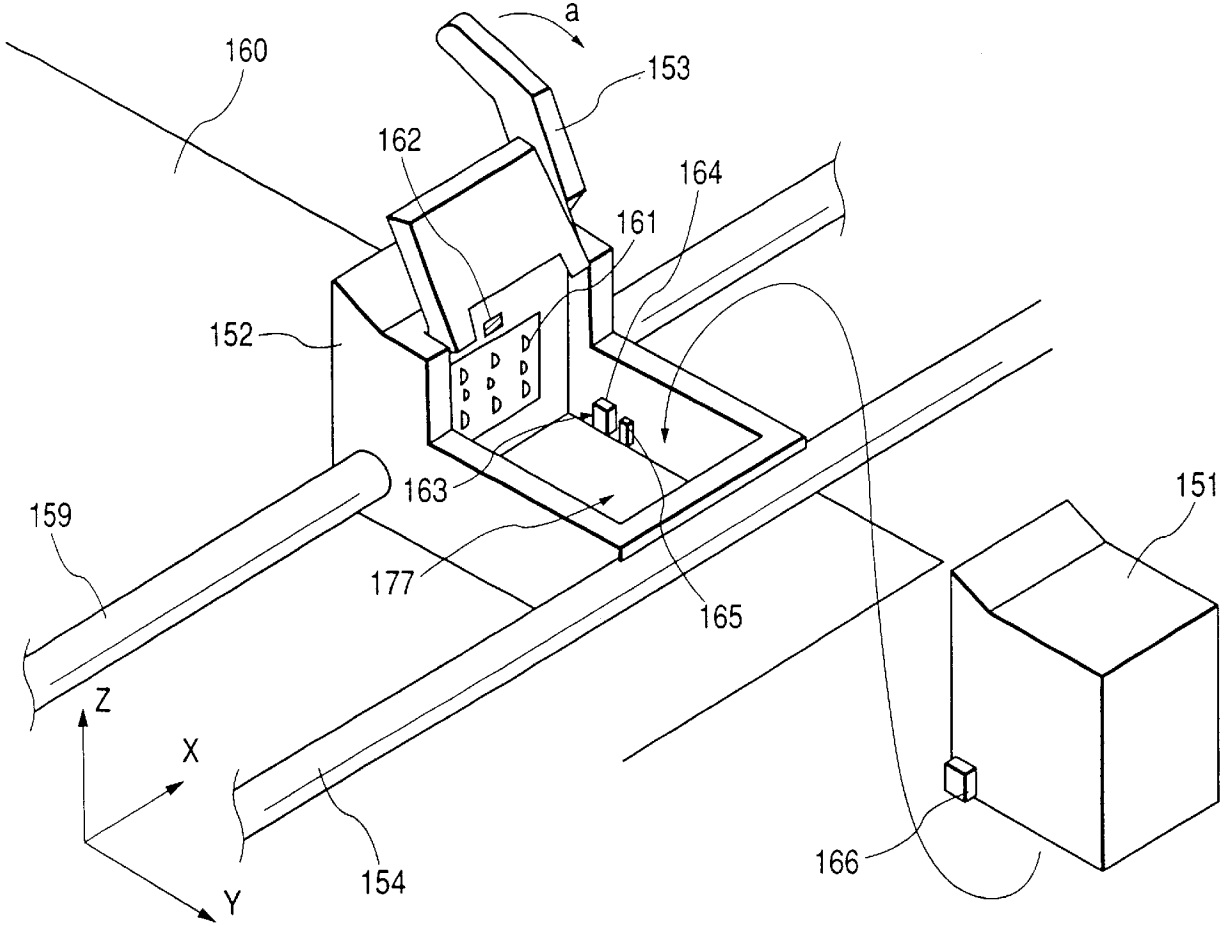
FIG. 16 PRIOR ART
FIG. 16 is a perspective view that shows schematically one example of the vicinity of the carriage of the conventional ink jet recording apparatus.
Figure 17B:
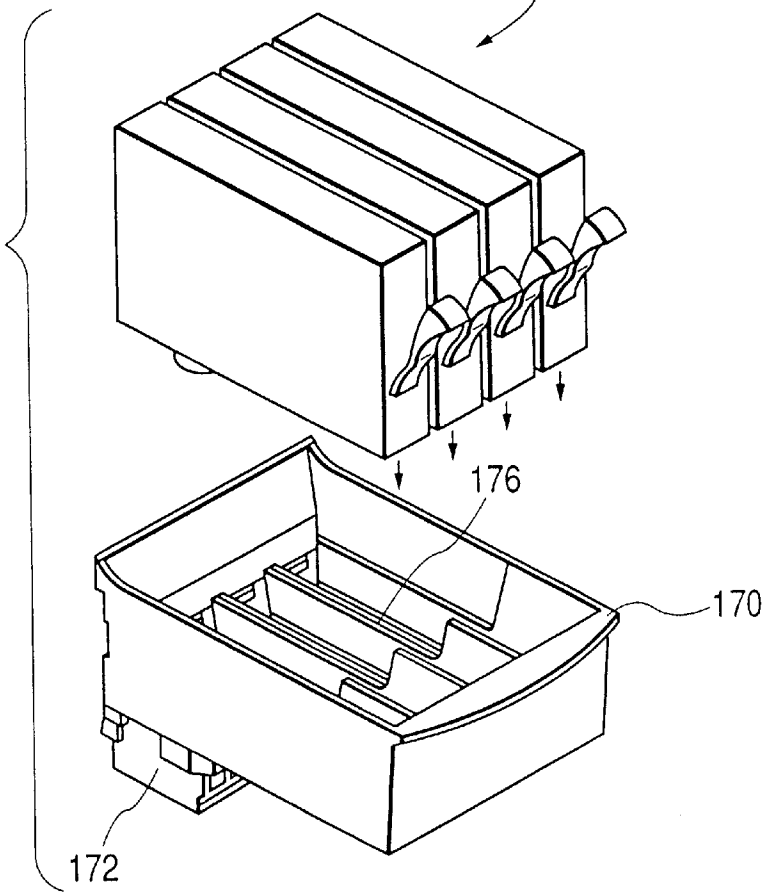
FIG. 17B PRIOR ART
FIGS. 17A and 17B are perspective views that illustrate one structural example of the conventional cartridge of disposable type.
Figure 17A:
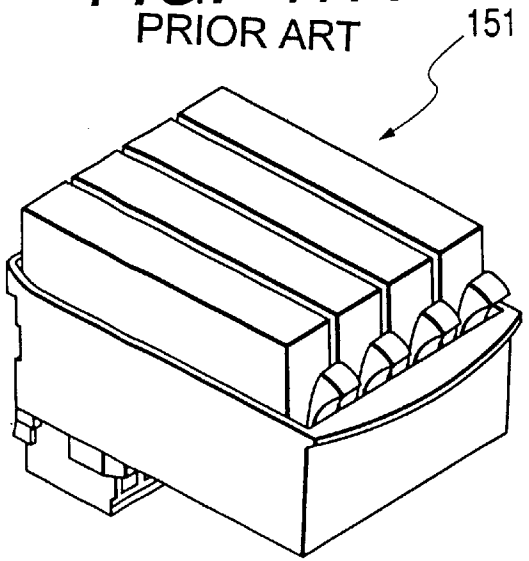
FIG. 17A PRIOR ART
Figure 18:
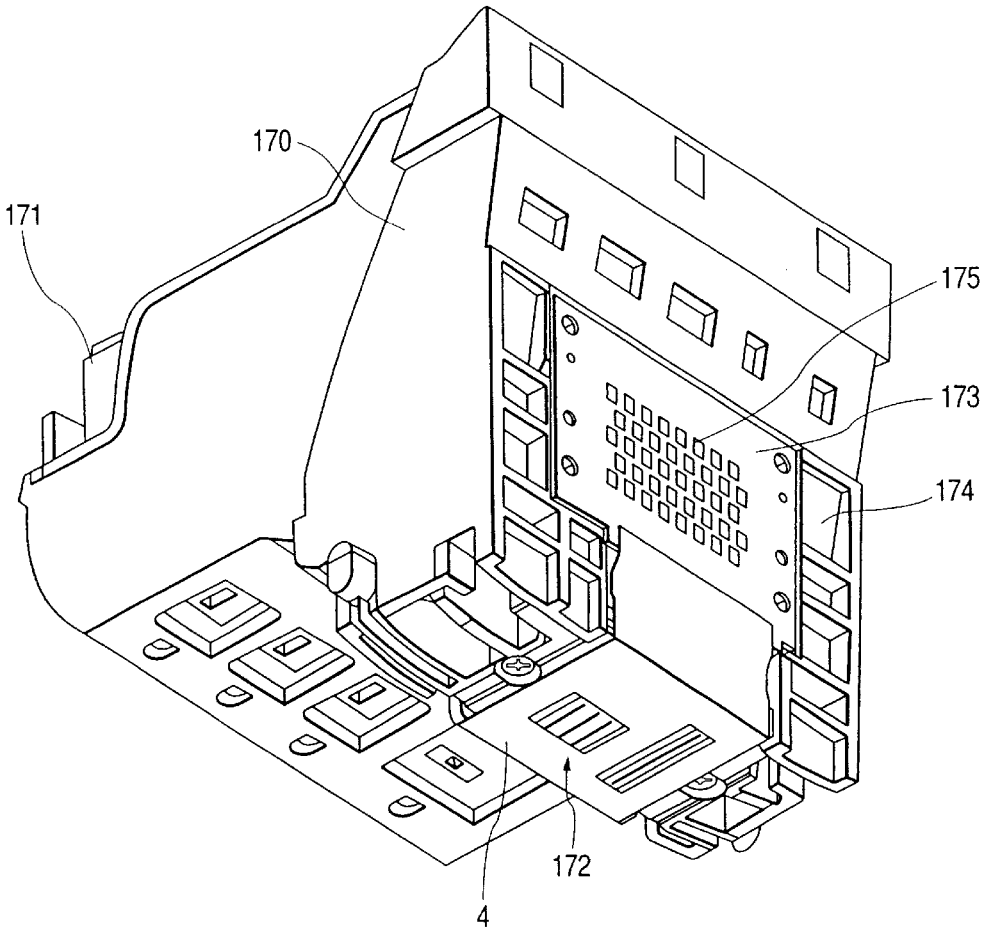
FIG. 18 PRIOR ART
FIG. 18 is a perspective view that shows the cartridge represented in FIGS. 17A and 17B, observed from the lower front side.
Figure 19:
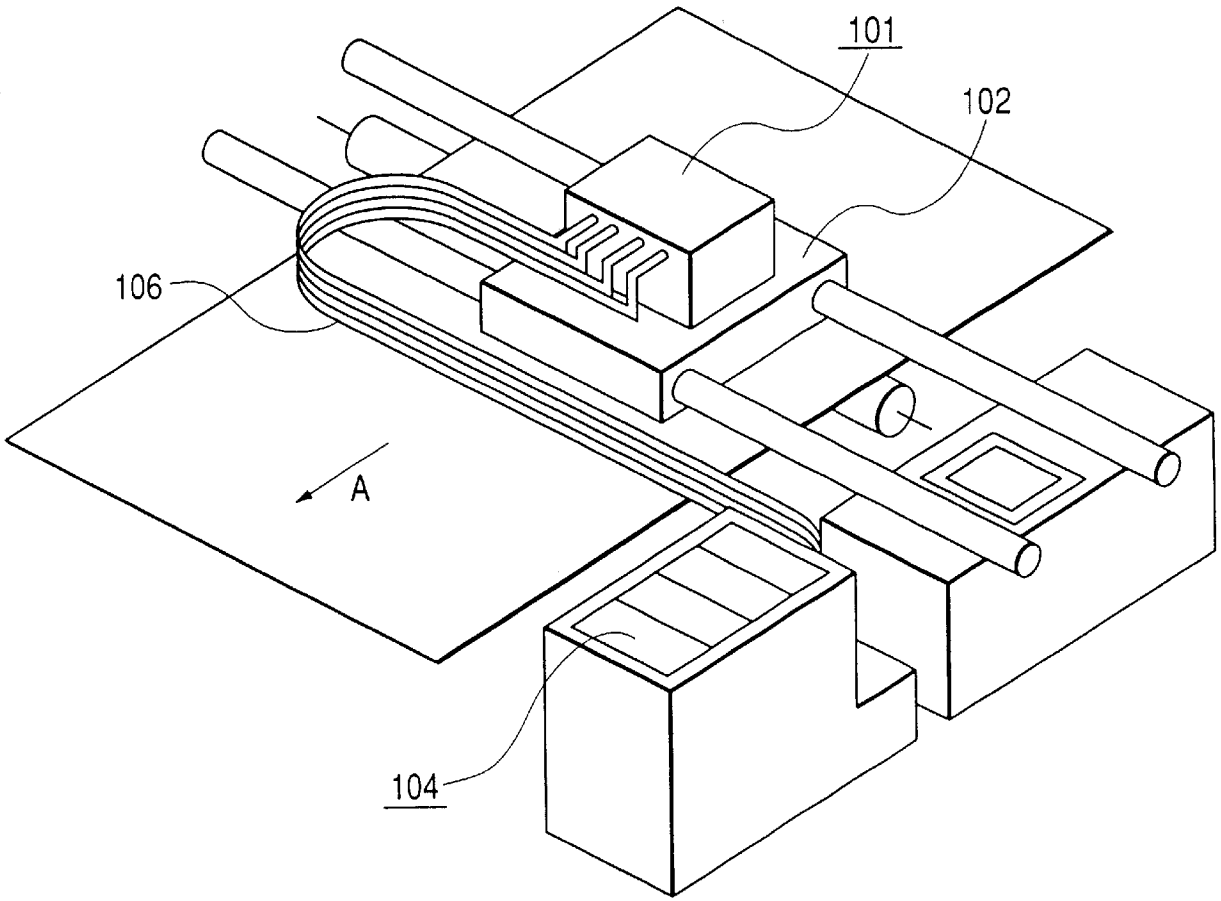
FIG. 19 PRIOR ART
FIG. 19 is a perspective view that shows schematically one example of the ink jet recording apparatus structured to fix an ink tank of large capacity on the recording apparatus main body side.

Next, the needle holding portion will be described. Here, FIG. 8 is a partially broken plan view that shows the needle holding portion. FIG. 11 is a perspective view that shows the cartridge in a state of both the head set lever and the ink connection lever being closed. FIGS. 15A, 15B, and 15C are views that illustrate each step of the procedure to remove the cartridge from the carriage, and the description will be made with reference thereto.

For the needle holding member 24 there are provided plural needles 30 to be inserted into each of the needle receptive portion 30 of the cartridge 3; the guiding boss 47 inserted into the boss hole 48 of the cartridge 3, which guides the insertion of the needle 30 into the needle receptive portion 23; and plural tube receptive portions 75 arranged on the rear face side of the surface where these needles 30 and guide boss 47 are provided, which are communicated with each of the needles 30 independently. At the corners of the guiding boss 47, the C-letter chamfering portion 81 is provided, and also, the C-letter chamfering portion 80 is provided for the boss hole 48 of the cartridge 3. Here, the structure is arranged so that when the needle holding member 24 is installed on the cartridge 3, the guiding boss 47 abuts against the boss hole 48 at first for guiding. The C-letter chamfering portion may be radially configured. In the needle holding member 24 the ink flow path is formed to communicate the needle 30 with the needle receptive portion 75 in such a manner that the tube 28 can be arranged on a position arbitrarily with respect to the needle 30. Also, with the tube receptive portion 75, is connected the other end of the tube 28 the one end of which is connected the main tank 2.

With the structure thus arranged, it becomes easier to connect each needle 30 with the needle receptive portion 23 provided for the cartridge 3 per color, while securing the bending area for the tube 28, thus contributing to minimizing the size of the main body. Also, with no unwanted force being exerted on the cartridge, the deformation of the cartridge can be prevented.

Also, the needle holding member 24 is slidably installed on the rail 62 provided for the carriage 1 by rotating the ink connection lever 22 as shown in FIGS. 15A, 15B, and 15C. The link 49 that enables the rotation of the ink connection lever 22 and needle holding member 24 to be interlocked is fixed to the pins 60 installed on both ends of the needle holding member 24. In other words, the structure is arranged so that with the rotation of the ink connection lever 22 in the CCW direction (in the order of FIGS. 15C, 15B and 15A), the needle 30 is inserted into the needle receptive portion 23. Then, with the rotation CW direction (in the order of FIGS. 15A, 15B, and 15C), the needle 30 is withdrawn from the needle receptive portion 23.

Figure 13:
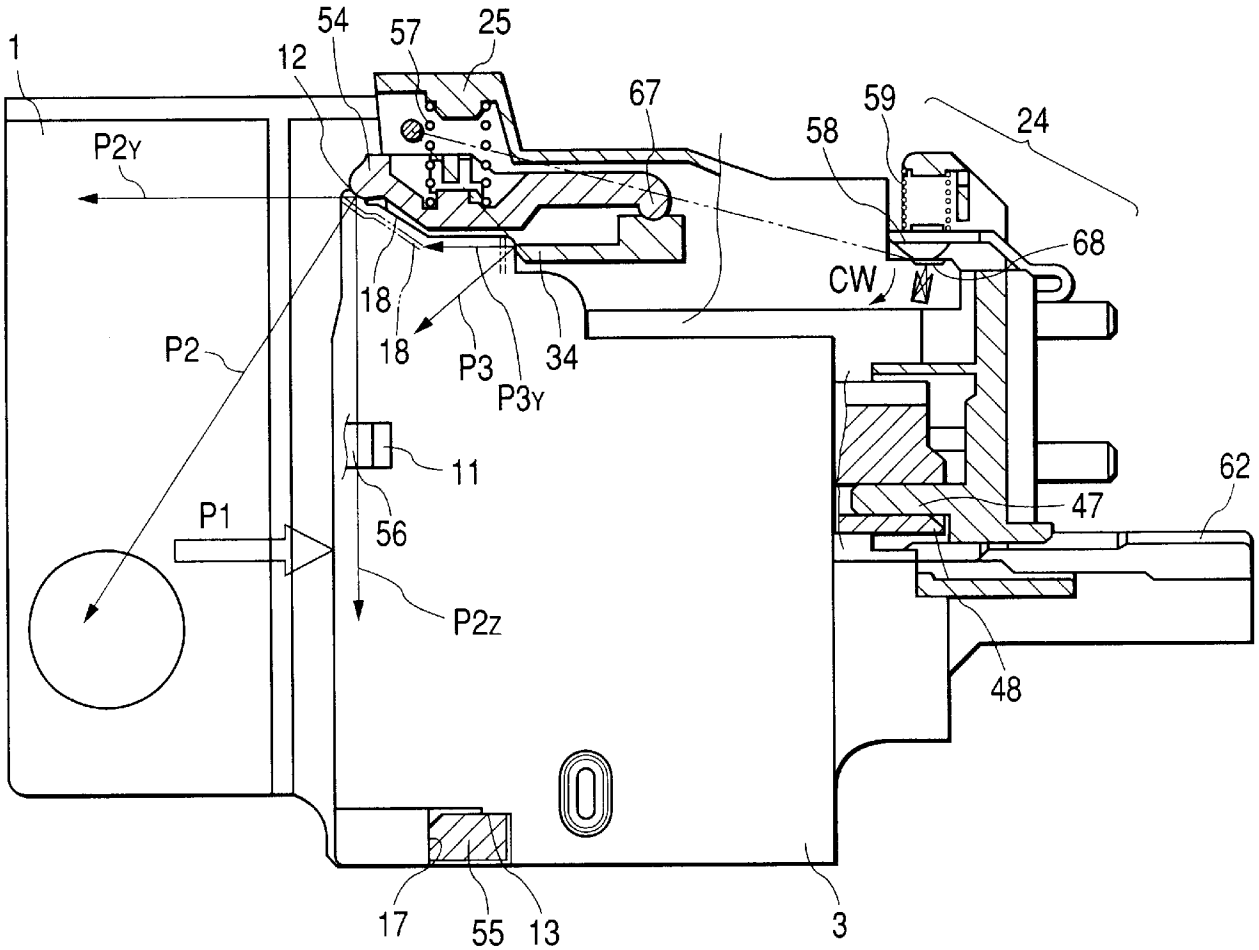
FIG. 13 is a view that illustrates each force exerted on the cartridge and the positioning unit.

Further, as shown in FIG. 13, on the upper part of the needle holding member 24, the pressure lever 58 that depresses the head set lever 25 downward. The pressure lever 58 is biased by a pressure spring 59 to depress the pressure lever 58 from the top to the bottom, that is, to bias the head set lever 25.

Here, in FIG. 8, the example is shown to insert four needles 30 into the needle receptive portion 23 of the cartridge 3, but the needles are not necessarily limited to that number. As described above, six needles can be provided without any problem in order to correspond to the six tubes 28 from the six main tanks 2. In this case, the numbers of tube receptive portions 75 become six corresponding to each of the needles 30 as a matter of course.

Next, in conjunction with FIG. 9 to FIGS. 15A, 15B, and 15C, the description will be made of the procedure to mount the cartridge 3 on the carriage 1. Here, in FIG. 9 to FIG. 11, which are perspective views, the cartridge 3 is omitted to simplify the representation.

At first, the positioning of the cartridge 3 to the carriage 1 will be described.

Figure 9:
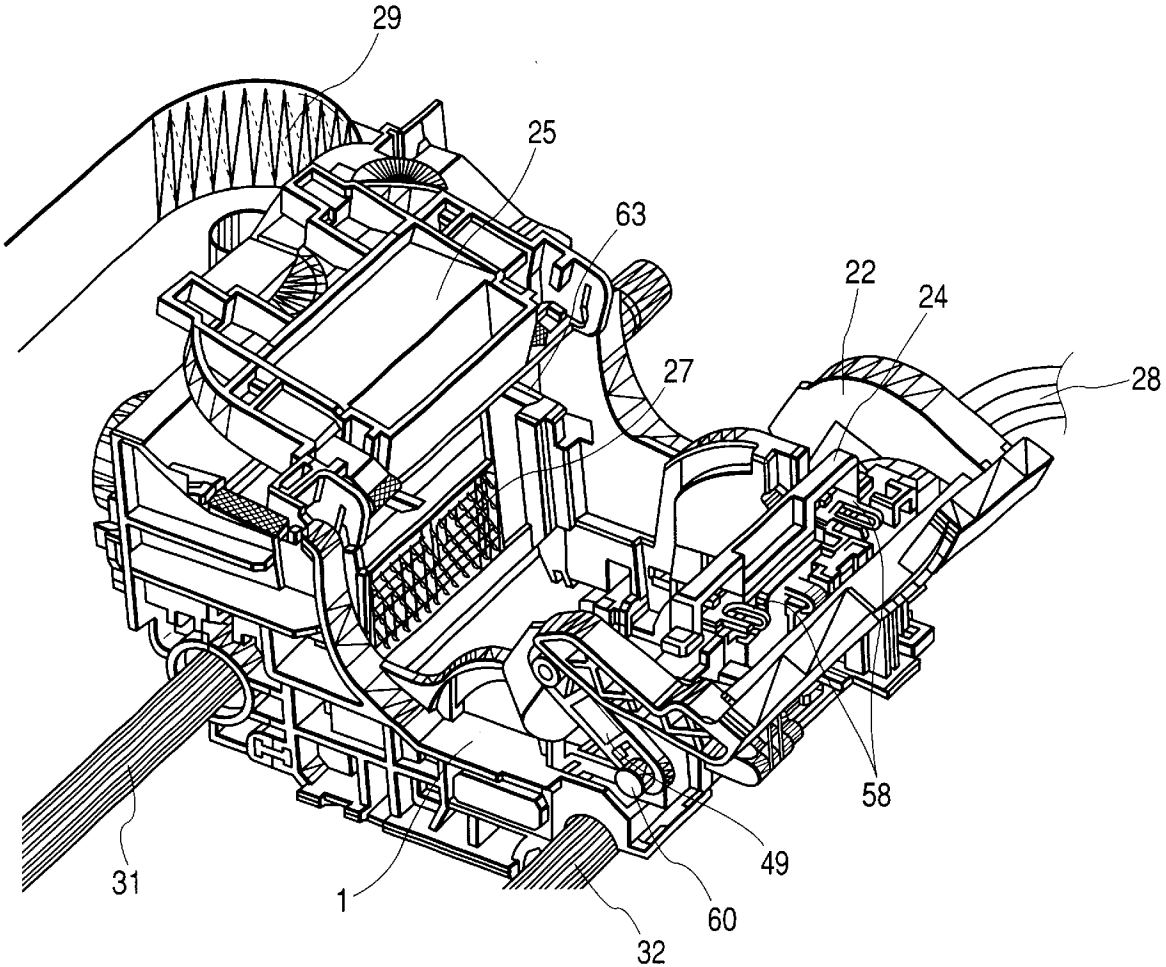
FIG. 9 is a perspective view that shows the cartridge in a state of both the head set lever and the ink connection lever being open.

FIG. 9 shows the state of both the head set lever 25 for fixing the cartridge 3 to the carriage 1, and the ink connection lever 22 to insert the needle 30 of the needle holding member 24 into the needle receptive portion 23 by sliding the needle holding member 24 being open. This state shown in FIG. 9 corresponds to the state shown in FIG. 12A of those which illustrate the procedure to mount the cartridge 3 on the carriage 1 per step.

When the cartridge 3 slides into the carriage 1, the extrusion 61 abuts, at first, against the bottom face of the carriage 1, while the support nail 63 of the head set lever 25 abuts upon the abutting portion 64 of the cartridge 3. In this state, the cartridge 3 is inclined to the carriage 1 with an inclination of −θX (in the CW (clockwise) direction in FIG. 12A), that is, it is inclined to the circumference of the axis X.

Figures 12A, 12B, 12C, 12D, 12E, 12F:
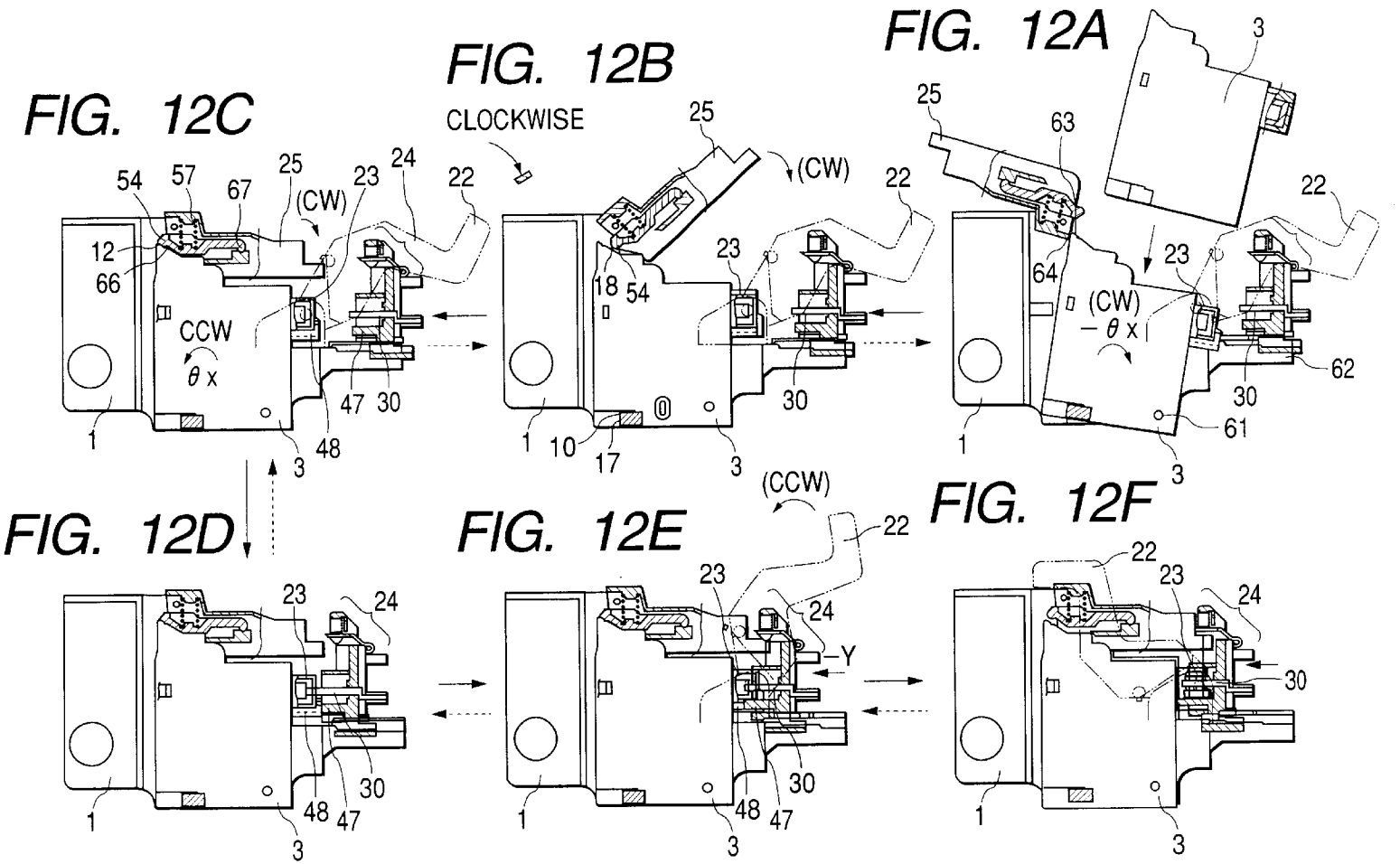
FIGS. 12A, 12B, 12C, 12D, 12E, and 12F are views that illustrate each step of the procedure in which the cartridge is mounted on the carriage.

Then, as shown in FIG. 12B, with the rotation of the head set lever 25 in the CW direction, the Z directional-positioning portion 13 near the bottom face of the carriage 1, the second Y directional-positioning portion 17, and the rotational center 10 of the cartridge 1 are in contact with the carriage 3. Also, the electrodes 4 of the head base plate 35 are partly in contact with the electrodes 27. However, even at this juncture, there exists the reaction force of the electrodes 27, and the cartridge 3 is still inclined at −θX inside the carriage 1 as shown in FIG. 12B.

Next, from the state shown in FIG. 12B, the head set lever 25 further rotates in the CW direction. Then, pressure P2 is exerted on the inclined portion 18 by means of the head set spring 57. This pressure P2 is divided, as shown in FIG. 13, into a component P2Y in the direction Y and a component P2Z in the direction Z. (However, in FIG. 13, the head set lever 25 is positioned at the first pressure portion 12.) Then, the cartridge 3 begins to rotate around the rotational center 10 of the head set portion when the rotational torque (CCW, θX direction) around the rotational center 10 by means of the component P2Y in the direction Y generated by the further rotation of the head set lever 25 becomes larger than the rotational torque (CW, −θX direction) around the rotational center 10 created by means of the reaction force of the electrodes 27. When the cartridge 3 makes this rotational motion, the head set portion 57, which is arranged inside the head set lever 25 rotatively around the rotational center 67 of the head set portion, and biased by the head set spring 57 in the cartridge 3 direction, slides on the inclined portion 18 while pressing the inclined portion 18 of the cartridge 3.

When the head set portion 57 moves over the hooking 66 to arrive at the position of the first pressure portion 12, the head set portion 57 presses the first pressure portion 12 that has been inclined by the pressure P2 exerted by the head set spring 57. Since the first pressure portion 12 is also inclined, the pressure P2 exerted by the head set spring 57 is, as shown in FIG. 13, divided into a component P2Y in the direction Y and a component P2Z in the direction Z. The component P2Z in the direction Z presses the cartridge 3 in the direction toward the lower face 41 of the carriage 1. With the component P2Z in the direction Z, the Z directional-positioning portion 13 of the cartridge 3 is pressed to the upper face of the first fixing portion 55 of the carriage 1 to determine the position of the cartridge 3 in the direction Z with respect to the carriage 1. Also, the component P2Y in the direction Y works in the −Y direction to rotate the cartridge 3 in the direction θX (CCW).

The position of the cartridge 3 in the direction θX is determined in such a manner that in the state where the rotational torque (CCW, θX direction) around the rotational center 10 exerted by the component P2Y in the direction Y becomes sufficiently over the rotational torque (CW, −θX direction) around the rotational center 10 exerted by the reaction force P1 of the electrodes 4 on the cartridge side, the first Y directional-positioning portion 11 serving as the rotation stopper for the θX abuts against the second fixing portion 56 of the carriage 1, and also, the second Y directional-positioning portion 17 is pressed to the first fixing portion 55 of the carriage 1. Here, with the first Y directional-positioning portion 11, which is provided for both sides, the right face side 45 and the left side face 46 of the cartridge 3, respectively, the position in the direction θZ is also determined at the same time that the position in the θX is set.

In this respect, the direction of the reaction force P1 received from the electrodes 27 and the force exerted by the second fixing portion 56 on the first Y directional-positioning portion 11 is almost equally directed.

In this manner, with the exception of the X direction, the position of the cartridge 3 is determined with respect to the carriage 1, but for the present embodiment, the structure is arranged so as to determine the position in the direction X approximately by removing looseness between the cartridge 3 and the carriage 1 to a certain extent. This is because when the cartridge 3 is positioned, the relations between each of the forces at X, Y, and Z should be such as to become weaker in the fixing order, and then, positioning is impeded unless such difference is sufficient.

As described above, the cartridge 3 is positioned with respect to the carriage 1.

Next, the description will be made of the procedure to insert the needle 30 into the needle receptive portion 23 by means of the auxiliary pressure P3 that acts upon the cartridge 3 positioned to the carriage 1, and the sliding of the needle holding member 24 as well.

Figure 10:
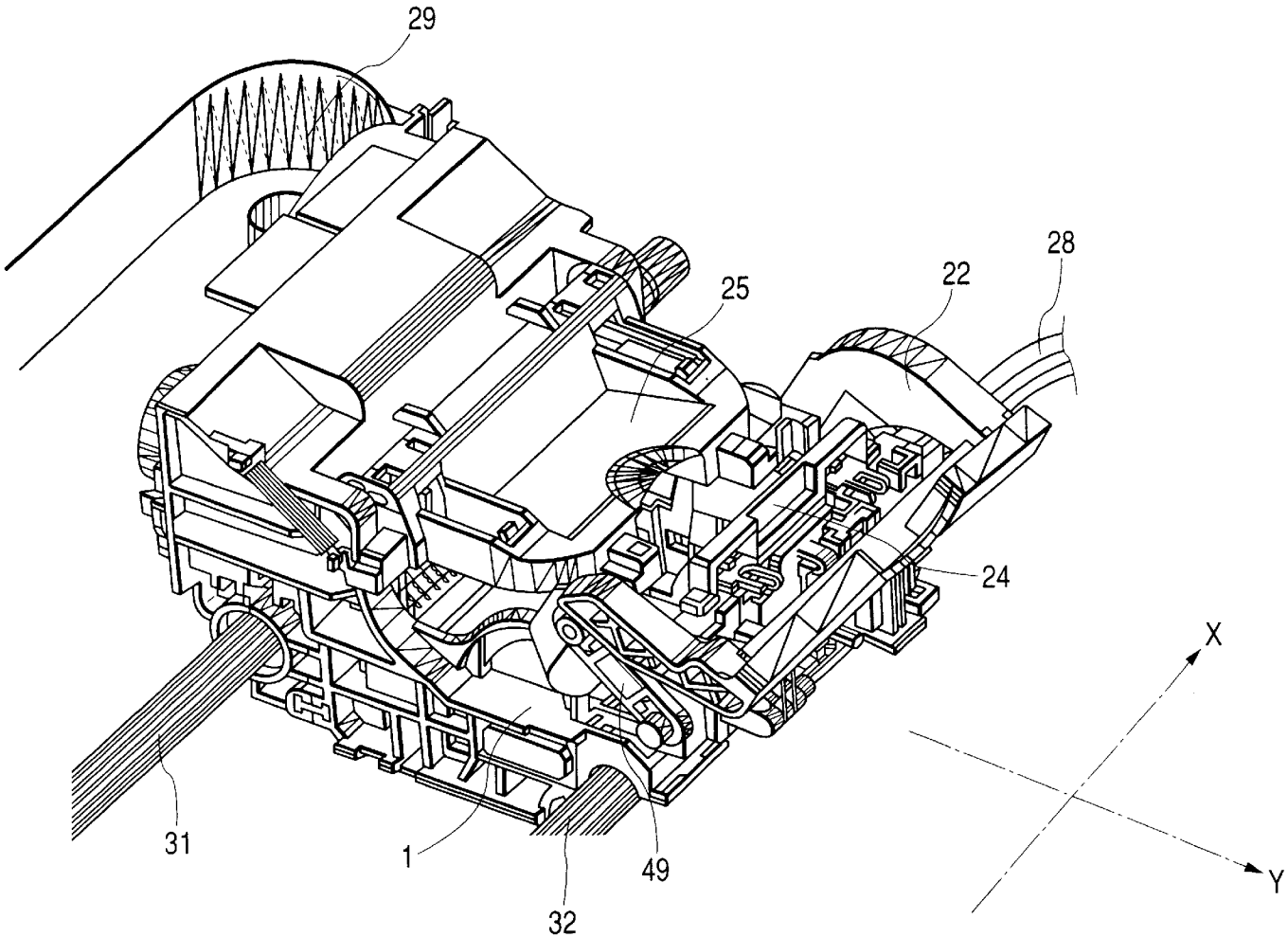
FIG. 10 is a perspective view that shows the cartridge in the state where only the head set lever is closed.

When the cartridge 3 is positioned with respect to the carriage 1 in the procedure described above, the head set lever 25 is closed, but as shown in FIG. 10 or FIG. 15C, the ink connection lever 22 is in a state of being open. The positional relation between the needle 30 and the needle receptive portion 23 is such as to make them apart as shown in FIG. 10, FIG. 12C or FIG. 15C.

When the ink connection lever 22 in the state of being open rotates in the CCW direction, the needle holding member 24, which is coupled with the ink connection lever 22 by use of the link 49, slides on the rail 62 as shown in FIG. 10 in the direction −Y as shown in FIG. 12E. Then, at first, the guiding boss 47 of the needle holding member 24 is inserted into the boss hole 48 of the cartridge 3. Subsequently, the insertion of the needle 30 into the needle receptive portion 23 begins, while being guided by the guiding boss 47 to the boss hole 48. The direction of the reaction force that the cartridge 3 receives from the needle 30 at the time of the insertion of the needle 30 is the one opposite to the direction of the reaction force that the cartridge 3 received from the electrodes 27 of the carriage 1. also, the directions of these reaction forces are almost in parallel to the arrangement direction of the discharge ports 29.

Here, the problem is that the reaction force that the cartridge 3 receives with the insertion of the needle 30 is the one exerted by the user's force. Therefore, if the needle is inserted forcefully, it is conceivable that an extreme force is exerted. However, this force is in the same −Y direction as those of the P2Y and P3Y. In other words, the force in the −Y direction is not allowed to become factors that may disorder the positioning of the cartridge 1 even if such force is exerted beyond them. Also, when withdrawing the cartridge 3 for removal, the opposite force is exerted as a matter of course, but this occurs along with the removal of the head, which does not present any problem.

Now, form the state shown in FIG. 12E, the ink connection lever 22 further rotates in the CCW direction. Then, as shown in FIG. 12F, the needle 30 is completely inserted into the needle receptive portion 23. Also, the ink connection lever 22 arrives at the closed position as shown in FIG. 11. In this closed position of the ink connection lever 22, the pressure lever 58 biased by the pressure spring 59 of the needle holding member 24 depresses the pressure portion 68 of the head set lever 25 downward as shown in FIG. 13. With this depression, the head set lever 25 tends to rotate in the CW direction. As a result, the fixing auxiliary member 34 of the head set lever 25 depressed the second pressure portion 19 of the cartridge 3. The Y directional component P3Y of the pressure P3 exerted by the fixing auxiliary member 34 on the second pressure portion 19 becomes the auxiliary force that enables the first Y directional-positioning portion 11 to abut upon the second fixing portion 56 of the carriage 1. This pressure P3 is auxiliary, and the intensity thereof is smaller than that of the pressure P2.

Figure 14:
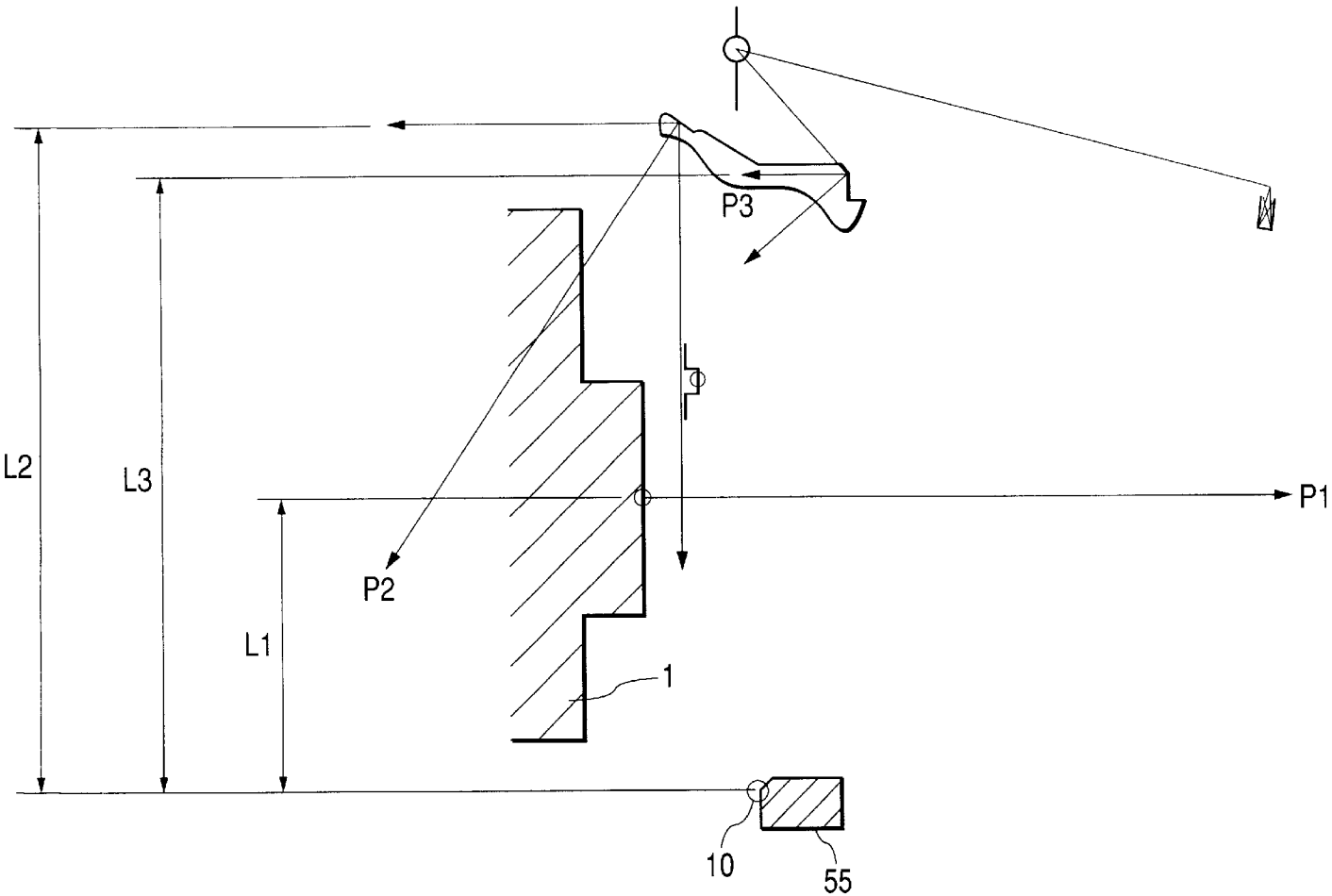
FIG. 14 is a view that shows the relations between pressure P1 from the carriage to the cartridge, pressure P2 from the cartridge to the carriage, and pressure P3 providing auxiliary pressure for the pressure P2 in terms of the rotational torques.

As described above, two forces, P2 and P3, are used for fixing the cartridge 3. This use of two forces aims at making the apparatus smaller. In accordance with the conventional art, only the P2 is used for completing the fixation of a cartridge in general. However, as shown in FIG. 14, it is necessary for the fixation of the cartridge 3 to make the rotational torque generated by the exertion of the P2 for fixing the cartridge 3 on the position away from the fulcrum by the distance L2 greater than the rotational torque exerted by the P1 to cause the cartridge 3 to part from the carriage 1 on the position away from the rotational center 10 by the distance L1. In order to make the rotational torque for fixing the cartridge 3 greater, it is conceivable to make the P2 greater or to make the L2 greater. If the P2 is made greater, the operational force should become greater to invite the unfavorable operability or invite deformation, because this force may exceed the limit of stress of the head set lever 25 or the head set portion 54, which are formed by molding. On the other hand, if the L2 is made greater while setting the P2 at an appropriate value, the size of the cartridge 3 should be made larger to ensue in the larger size of the apparatus eventually.

In contrast, the present embodiment is such that the cartridge 3 is not fixed only by means of the P2, but the structure is arranged to add the P3 that is the auxiliary force, hence making it unnecessary to make the P2 or L2 greater. As a result, the cartridge 3 can be made smaller. Also, the P3 is exerted by the utilization of the needle holding structure formed by the needle holding member 24, the ink connection lever 22, and others. Therefore, the increase part is only the pressure spring 59.

For removing the carriage 3 thus fixed from the carriage 1, the ink connection lever 22 rotates in the CW direction at first as shown in FIG. 15A to FIG. 15C to withdraw the needle 30 of the needle holding member 24 from the needle receptive portion 23. At this juncture, the needle holding member 24 slides on the rail 62 in the +Y direction, but it is slidably installed on the carriage 1 by use of the spring 37 that biases the needle holding member 24 in the −Y direction. Therefore, the needle holding member 24 is not caused to fall off from the rail 62. After the needle 30 is withdrawn from the needle receptive portion 23 and the ink connection lever 22 is in the state of being open, the head set lever 25 moves in the CCW direction as shown in FIG. 12C to FIG. 12A to be in the state of being released, thus conditioning the cartridge 3 to be removed from the carriage 1.

As described above, the cartridge 3 of the present embodiment secures robustness in the direction Y by use of the partition wall 50 that serves as the beam in the direction Y, and the ribs 15 of the face cover 7. As a result, it is made possible to secure the flatness of the head base plate 35 against the reaction force that it receives from the electrodes 27 in the direction Y, hence obtaining the stabilized electrical connection between the electrodes 27 and the electrodes 4 on the cartridge side.

Also, the cartridge 3 of the present embodiment is structured to receive the reaction force exerted by the insertion of the needle 30 with the rear face 43 opposite to the front face 42 that received the reaction force from the electrodes 27. Therefore, the direction of the reaction force that the cartridge 3 received by the insertion of the needle 30 is the one opposite to the direction of reaction force that the cartridge 3 receives from the electrodes 27, that is, the −Y direction in which the positioning force of the cartridge 3 is exerted. As a result, it becomes possible to suppress the lowering of the precision with which the ink jet recording head 69 should be positioned by the insertion of the needle 30. Also, the front face 42 that serves as the electrical connection face and the rear face 43 serving as the ink connection face are away from each other. Therefore, even if there is ink leakage from the needle receptive portion 23, it is possible to minimize the danger that the electrodes 27 and the electrodes 4 on the cartridge side are wetted by such ink leakage. Further, the plate member having the ribs of the cartridge in accordance with the present invention is effective in collecting the deformation of the cartridge that may result from molding or assembling.

Further, all the positioning portions are installed on the right side face 45 and the left side face 46. Then, the major face is substantially in parallel with each direction of the force needed for fixing the cartridge 3, and the reaction force exerted from the electrodes 27 along with this fixation, thus making it possible to minimize the deformation of the cartridge 3 even if these forces may be exerted on the cartridge. In this way, the lowering of the positioning precision that may be caused by the deformation of the cartridge 3 can be suppressed for the ink jet recording head 69.

Also, the cartridge 3 of the present embodiment can simply protect the pressure adjustment chamber 8, but with the installation of the face cover 7 having the function as a member material with ribs 15, it becomes possible to suppress effectively the deformation of the cartridge 3 still more.

Also, the force needed for fixing the cartridge 3 to the carriage 1 is divided into the main pressure P2 and the pressure P3 that supports the pressure P2, not exerted only one means at a time. Thus, it is made possible to avoid such problems as to deteriorate the operability due to the increased operational force, to cause the head set lever 25 or head set portion 54 to be deformed, or to make the apparatus larger.

As described above, the cartridge is positioned to holding means against the force exerted on the front face by the electrical connection between the electrodes on the cartridge and the electrodes on holding means. Then, the force needed for connecting supply means on the rear face opposite to the front face is exerted in the same direction of the positioning force for the cartridge of the present invention. As a result, the force needed for connecting supply means does not produce any unfavorable effect on the precision with which the cartridge should be positioned to holding means, hence securing highly precise positioning.

Also, the cartridge of the present invention provides the partition wall that becomes the beam for linking the front face and rear face, and the plate member having ribs for the upper surface of the cartridge main body, thus securing robustness against the force exerted on the front face by the electrical connection.

Further, the carriage of the present invention applies the force needed for fixing the cartridge to the carriage by dividing it into two, each applied to first fixing means and second fixing means, respectively, making it unnecessary to exert a large force at a time for such fixation. As a result, the operability of the fixation is improved, while preventing fixing means, and the apparatus itself, from being made larger.

What is claimed is:

1. A cartridge detachably mountable on holding means of an ink jet recording apparatus so as to be freely reciprocatable to scan across a recording medium for recording on the recording medium by discharging ink thereto, said cartridge being defined by a cartridge main body, said cartridge main body having a lower face which faces the recording medium when said cartridge is mounted on the holding means, a front face, and a rear face opposite to said front face, wherein said lower face is provided with a recording head for discharging ink from plural nozzles formed in parallel on the lower face, wherein said front face is provided with an electrical connection portion having at least one cartridge electrode electrically connectable with a corresponding electrode on said holding means, and wherein said rear face is provided with an ink connection portion connectable to corresponding supply means for supplying ink from a main tank installed elsewhere on said ink jet recording apparatus to said recording head said cartridge further comprising:

a first pressure portion to receive a first pressure for fixing the holding means by division of the first pressure into a frontward depression in a direction toward the front face for positioning in said front face, and a downward depression for positioning in a direction of said lower face; and a second pressure portion to receive a second pressure for assisting said frontward depression, wherein said first pressure portion has an inclined face to said front face, and said second pressure portion has a face substantially in parallel to said front face, and wherein said cartridge receives a reaction force in the direction of said front face direction, said reaction force and said frontward depression being substantially in the same direction.

2. A cartridge according to claim 1, wherein the cartridge electrode is pressed to the electrode on said holding means for electrical connection thereto and receives said reaction force exerted by connecting said supply means with said ink connection portion in a direction opposite to a direction of a second reaction force received from the electrodes on said holding means.

3. A cartridge according to claim 2, further comprising, plural positioning portions for positioning said cartridge on the holding means, the plural positioning portions being provided for two faces of said cartridge main body except for said front face, said rear face, said lower face, and an upper face opposite to said lower face.

4. A cartridge according to claim 3, wherein said two faces are side faces of said cartridge main body substantially in parallel to the direction of said second reaction force.

5. A cartridge according to claim 1, wherein said cartridge main body has each of its faces formed integrally except for an upper face opposite to said lower face.

6. A cartridge according to claim 5, wherein said cartridge is provided with a plate member inserted into an opening arranged for said upper face of said cartridge main body to close said opening on said upper face of said cartridge main body.

7. A cartridge according to claim 1, wherein said cartridge is provided with plural ink retaining portions to retain ink supplied from said supply means partitioned by plural partition walls linking said front face and said rear face.

8. A cartridge according to claim 7, wherein each of said partition walls is formed integrally with said cartridge main body.

9. A cartridge according to claim 7, wherein the cartridge electrode is pressed to the electrode on said holding means for electrical connection thereto and receives said reaction force exerted by connecting said supply means with said ink connection portion in a direction opposite to a direction of a second reaction force received from the electrodes on said holding means; and wherein each of said partition walls is formed to make the longitudinal direction thereof substantially the same as the direction of said first reaction force.

10. A cartridge according to claim 7, wherein said cartridge is provided with a pressure adjustment chamber formed by elastic material communicated with an upper part of each of said plural ink retaining portions.

11. A cartridge according to claim 1, wherein a lattice-type rib structure is provided for a backside of the cartridge electrode on said front face of said cartridge main body.

12. A cartridge according to claim 1, wherein on an upper face opposite to said lower face of said cartridge main body structured essentially by six faces, said cartridge is provided with a plate member having at least one rib connected under pressure with said front face and said rear face at both ends thereof by being inserted and fitted into an opening on said upper face side.

13. A cartridge according to claim 12, wherein said plate member is structured to abut against said opening for fixation.

14. A cartridge according to claim 12, wherein for said plate member, two rib-type faces are formed to be connected under pressure with inner side faces of said front face and rear face, and at least one continuous rib is formed to intersect with said two rib-type faces.

15. A cartridge according to claim 14, wherein at least one reinforcement rib is formed in a direction intersecting with said rib connected under pressure or said continuous rib intersecting with said rib-type faces.

16. A cartridge according to claim 15, wherein said plate member is chamfered in a C-shape or radiused at radius R.

17. A cartridge according to claim 14, wherein said rib connected under pressure or said continuous rib intersecting with said rib-type faces is made thicker in a central portion thereof than an end portion thereof.

18. A cartridge according to claim 14, wherein on each inner side of said front face and said rear face, a groove is formed respectively for said rib or each of both ends of said rib-type faces to assist insertion of said plate member by guiding each of said both ends.

19. A cartridge according to claim 18, wherein each of said grooves is inclined to expand toward the opening on said upper face side.

20. A cartridge according to claim 19, wherein a bottom face of each of said grooves between a position at the bottom face of each of said grooves having an inclination formed therefor and a position at each of said ribs directed toward said bottom face or toward an abutting face of rib-type faces substantially parallel to said front face.

21. A cartridge according to claim 14, wherein said rib or said rib-type faces, and said reinforcement ribs, are formed integrally with said plate member.

22. A cartridge according to claim 1, wherein said supply means is formed by plural needles for supplying ink to said cartridge, and plural bosses for guiding corresponding ones of said plural needles as said needles are connected to said ink connection portion.

23. A cartridge according to claim 22, wherein said ink connection position comprising plural boss holes corresponding to said plural bosses, and said boss holes being arranged to enable said plural bosses and boss holes to abut upon each other prior to contact by said plural needles when said supply means is connected with said ink connection portion of said cartridge.

24. A cartridge according to claim 23, wherein corners of said plural bosses are in a C-shape or radiused at radius R and/or said boss holes are chamfered in a C-shape or radiused at radius R.

25. An ink jet recording apparatus provided with carrying means for carrying a recording medium for recording by discharging ink to said recording medium, wherein said ink jet recording apparatus is provided with a cartridge according to claim 1.

26. An ink jet recording apparatus according to claim 25, wherein said front face of said cartridge faces toward an interior of said ink jet recording apparatus when installed on the holding means.

27. A holding apparatus detachably holding a recording head cartridge on an ink jet recording apparatus which records by discharging ink to a recording medium, the recording head cartridge being defined by a main body having a front face and a rear face opposite the front face, the cartridge including:

a recording head portion provided with a plurality of nozzles for discharging ink formed in parallel on the lower face of the recording head cartridge main body, the recording head portion having a plurality of ink chambers communicated with said nozzles;

a cartridge electrode provided on the front face of said recording head cartridge main body; and a plurality of ink supply port for supplying ink to said plurality of ink chambers, the ink supply ports being provided on the rear face of said recording head cartridge main body, the ink supply ports being supplied with the ink in a direction toward said front face from said rear face, said holding apparatus comprising:

a mounting portion for mounting said recording head cartridge;

an electrode in electrically conducted contact with said cartridge electrode; and a holding member for holding a plurality of connection portions for supplying ink to said plurality of ink supply ports, the holding member at one time connecting each of said plurality of connection portions with corresponding one of said plurality of ink supply ports toward said front face side from said rear face.

28. An ink jet recording apparatus comprising:

a holding apparatus according to claim 27; and a retaining member for retaining ink to be supplied to said plurality of ink supply ports through said plurality of connection portions.

* * * * *

UNITED STATES PATENT AND TRADEMARK OFFICE

CERTIFICATE OF CORRECTION

PATENT NO. : 6,851,795 B2
DATED : February 8, 2005
INVENTOR(S) : Watanabe et al.

It is certified that error appears in the above-identified patent and that said Letters Patent is hereby corrected as shown below:

Title page,
Item [*] Notice, please delete and insert the following:
-- Subject to any disclaimer, the term of this patent is extended or adjusted under 35 U.S.C 154(b) by 72 days. --.

Signed and Sealed this

Eleventh Day of October , 2005

JON W. DUDAS
*Director of the United States Patent and Trademark Office*